US006956954B1

(12) United States Patent
Takemura et al.

(10) Patent No.: US 6,956,954 B1
(45) Date of Patent: Oct. 18, 2005

(54) SURROUND-SOUND PROCESSING SYSTEM

(75) Inventors: Kazumasa Takemura, Neyagawa (JP); Joji Kasai, Neyagawa (JP); Tetsuro Nakatake, Neyagawa (JP); Sadatoshi Hisamoto, Neyagawa (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 09/555,908

(22) PCT Filed: Oct. 15, 1999

(86) PCT No.: PCT/JP99/05694

§ 371 (c)(1),
(2), (4) Date: Jun. 6, 2000

(87) PCT Pub. No.: WO00/24226

PCT Pub. Date: Apr. 27, 2000

(30) Foreign Application Priority Data

Oct. 19, 1998 (JP) ..... 10-296708

(51) Int. Cl.[7] ..... H04R 5/02; H04R 5/00

(52) U.S. Cl. ..... 381/307; 381/17; 381/18; 381/1; 381/308; 381/310

(58) Field of Search ..... 381/17, 18, 1, 381/307, 308, 310

(56) References Cited

U.S. PATENT DOCUMENTS

| | | | | |
|---|---|---|---|---|
| 5,844,993 | A * | 12/1998 | Ilda et al. | 381/18 |
| 6,084,970 | A * | 7/2000 | Aarts et al. | 381/17 |
| 6,144,747 | A * | 11/2000 | Scofield et al. | 381/309 |
| 6,175,489 | B1 * | 1/2001 | Markow et al. | 361/683 |
| 6,498,857 | B1 * | 12/2002 | Sibbald | 381/310 |
| 6,721,425 | B1 * | 4/2004 | Aylward | 381/22 |

FOREIGN PATENT DOCUMENTS

JP H03128400 12/1991

(Continued)

OTHER PUBLICATIONS

Bauck, Jerry, Generalized Transaural Stereo and Applications , Sep. 1996, Journal of Audioo Engineering Society, vol. 44, No. 9, pp. 693-694, Figure 5.*

(Continued)

*Primary Examiner*—Xu Mei
*Assistant Examiner*—Devona E Faulk
(74) *Attorney, Agent, or Firm*—Amin & Turocy, LLP

(57) ABSTRACT

Surround-effect, providing no unnatural feeling to the listeners who sit next to each other under side-by-side basis through virtual sound sources, is realized. A surround left channel signal SL and a surround right channel signal SR are mixed with an adder 10 and are in monaural. A first monophonic signal and a second monophonic signal thus resulted are supplied to a virtual localization processor 12. A first virtual localization output of the processor 12 is supplied to a front left speaker SPL and a front right speaker SPR and a second virtual localization output thereof is supplied to a front center speaker SPC. In this way, virtual sound sources can be created at the right and the left to the listener 2. Similarly, virtual sound sources can also be created at the right and the left to the listener 3. Sound fields from the virtual surround sources are in reverse to the listener 2 and the listener 3. However, no substantial drawbacks caused by the reversal are observed because monophonic signals are reproduced as the surround signals in this embodiment. In this way, surround-effect with natural feeling can be achieved.

24 Claims, 32 Drawing Sheets

FOREIGN PATENT DOCUMENTS

| | | | | |
|---|---|---|---|---|
| JP | 06 165298 A | * | 6/1994 | ..... H04S 1/00 |
| JP | 6165298 | | 6/1994 | ..... H04S 1/00 |
| JP | 8182097 | | 7/1996 | ..... H04S 7/00 |
| JP | 8265899 | | 10/1996 | ..... H04S 1/00 |
| JP | 9327099 | | 12/1997 | ..... H04S 1/00 |

OTHER PUBLICATIONS

Bauck, et al., "Generalized Transaural Stereo and Applications," J. Audio Eng. So., vol. 44, No. 9, Sep. 1996.
International Search Report.

* cited by examiner

SURROUND-SOUND PROCESSING SYSTEM

CROSS-REFERENCE TO RELATED APPLICATIONS

The disclosure of Japanese Patent Application No. H10-296708 (filed on Oct. 19, 1998), including specification, claims, drawings and abstract is incorporated herein by reference in its entirety.

BACKGROUND OF THE INVENTION

1. Field of the Invention

The present invention relates to processing for localizing sound images, more particularly to virtual localization processing to a plurality of listeners.

2. Description of the Prior Art

Reproduction of multi-channel-audio-signals is performed with a front center speaker, a surround left speaker, and a surround right speaker in addition to speakers arranged at the front left and the front right side to the listener. Both the surround left speaker and the surround right speaker are arranged at either beside the listener or backward thereto, and sound field just as enveloping the listener is reproduced therewith. Devices, which reproduce the sound field as a virtual sound source, have been proposed due to the limitation in spaces for speaker placement. In such device, signals for front left channel, front center channel, and front right channel are respectively provided to the front left speaker, the front center speaker, and the front right speaker. As depicted in FIG. 31, both a surround left channel signal SL and a surround right channel signal SR are processed with filters 6*a*, 6*b*, 6*c*, 6*d* and the resulting signals are provided to both a front left speaker 4L and a front right speaker 4R. The listener feels like that speakers XL and XR are arranged at positions behind him/her if transfer functions H11, H12, H21, and H22 of the filters 6*a*, 6*b*, 6*c* and 6*d* are respectively represented by the following equations:

Here, $h_{RL}$ is a transfer function from the speaker 4R to the left ear 2L of the listener 2, $h_{RR}$ is a transfer function from the speaker 4R to the right ear 2R of the listener 2; $h_{LL}$ is a transfer function from the speaker 4L to the left ear 2L of the listener 2, $h_{LR}$ is a transfer function from the speaker 4L to the right ear 2R of the listener 2.

In this way, a sound source reproducing the sound field through which the listener feels that he/she is surrounded therewith, is obtained without placing surround speakers beside and/or behind the listener.

Another method having much simple processes, in which the reproduction of both the surround left channel signal SL and the surround right channel signal SR is carried out by a phase shift control without performing virtual localization processing, has been proposed as depicted in FIG. 32, the surround left channel signal SL and the surround right channel signal SR being processed under the phase difference control such that just reversing their phases.

In the device depicted in FIG. 31, however, the positions of the listener 2 where enable to obtain the surround sound source are strictly limited to a certain area located along with a central axis 8 extending between the listener 2 and the middle point between the front left and the front right speakers. Consequently, it is substantially impossible for the device to provide an appropriate surround-effect simultaneously to listeners if two or more of them exist.

In the method as depicted in FIG. 32, there is a high probability that the sound field reproduced with the surround signals is undesiredly localized at positions out of the certain area because symmetry between the speakers 4R and 4L relative to the central axis 8 is not satisfied at positions away from the central axis 8.

The primary object of the present invention is to overcome the above mentioned problems and to provide a surround signal processing system capable of obtaining the surround sound source localized virtually even when a plurality of listeners sit next to each other under side-by-side basis. Another object of the present invention is to provide a surround signal processing system with simple structure capable of localizing sound field without causing undesired shift in localization even when a plurality of listeners sit next to each other under side-by-side basis.

SUMMARY OF THE INVENTION

It is an object of the present invention to overcome the above mentioned problems and to provide a surround signal processing system capable of obtaining surround sound sources localized virtually even when a plurality of listeners sit next to each other under side-by-side basis.

In accordance with characteristics of the present invention, there is provided a processing method of a surround signal for virtually creating a surround left sound source and a surround right sound source to a first listener and a second listener through a front left speaker, a front center speaker, and a front right speaker, comprising the steps of:

placing the front left speaker and the front center speaker respectively to front left side and front right side of the first listener;

placing the front center speaker and the front right speaker respectively to a front left side and a front right side of the second listener;

arranging the front left speaker and the front right speaker symmetrically with respect to a central axis extending from the front center speaker and to the middle point between the first listener and the second listener, while arranging the first listener and the second listener symmetrically with respect to the central axis;

performing virtual localization processing to a given surround signal so as to produce a signal for creating virtual sound sources, and supplying the produced signal to the front left speaker, the front center speaker and the front right speaker; and supplying the same signal for creating virtual sound sources to the front left speaker and the front right speaker so as to create the surround left sound source and the surround right sound source to both the first listener and the second listener.

Also, in accordance with characteristics of the present invention, there is provided a surround signal processing system for virtually creating a surround left sound source and a surround right sound source through a front left speaker, a front center speaker and a front right speaker upon receipt of a front left channel signal, a front center channel signal, a front right channel signal, a surround left channel signal and a surround right channel signal;

wherein resulting signals generated by mixing the surround left channel signal and the surround right channel signal are supplied to a virtual localization processing means as a first monophonic signal and a second monophonic signal while the front left channel signal, the front center channel signal and the front right channel are supplied respectively to the front left speaker, the front center speaker and the front right speaker;

wherein a first virtual localization output of the virtual localization processing means is supplied to the front left speaker and the front right speaker; and wherein a second virtual localization output of the virtual localization processing means is supplied to the front center speaker.

Further, in accordance with characteristics of the present invention, there is provided a surround signal processing system for virtually creating a surround left sound source and a surround right sound source through a front left speaker, a front center speaker and a front right speaker upon receipt of a surround left channel signal and a surround right channel signal;

wherein resulting signals generated by mixing the surround left channel signal and the surround right channel signal are supplied to a virtual localization processing as a first monophonic signal and a second monophonic signal;

wherein a first virtual localization output of the virtual localization processing means is supplied to the front left speaker and the front right speaker; and wherein a second virtual localization output of the virtual localization processing means is supplied to the front center speaker.

In accordance with characteristics of the present invention, there is provided a surround signal processing system for virtually creating a surround left sound source and a surround right sound source through a front left speaker, a front center speaker and a front right speaker upon receipt of surround channel signals;

wherein the surround channel signals are supplied to a virtual localization processing means as a first monophonic signal and a second monophonic signal;

wherein a first virtual localization output of the virtual localization processing means is supplied to the front left speaker and the front right speaker; and wherein a second virtual localization output of the virtual localization processing means is supplied to the front center speaker.

Also, in accordance with characteristics of the present invention, there is provided a surround signal processing device for virtually creating a surround left sound source and a surround right sound source through a front left speaker, a front center speaker and a front right speaker upon receipt of a front left channel signal, a front center channel signal, a front right channel signal, a surround left channel signal and a surround right channel signal;

wherein resulting signals generated by mixing the surround left channel signal and the surround right channel signal are supplied to a virtual localization processing means as a first monophonic signal and a second monophonic signal;

wherein a signal at least containing the front left channel signal and a first virtual localization output of the virtual localization processing means is output as a signal for the front left speaker;

wherein a signal at least containing the front right channel signal and the first virtual localization output of the virtual localization processing means is output as a signal for the front right speaker; and wherein a signal at least containing the front center channel signal and a second virtual localization output of the virtual localization processing means is output as a signal for the front center speaker.

Further, in accordance with characteristics of the present invention, there is provided a surround signal processing device for virtually creating a surround left sound source and a surround right sound source through a front left speaker, a front center speaker and a front right speaker upon receipt of a surround left channel signal and a surround right channel signal;

wherein resulting signals generated by mixing the surround left channel signal and the surround right channel signal are supplied to a virtual localization processing means as a first monophonic signal and a second monophonic signal;

wherein a signal at least containing a first virtual localization output of the virtual localization processing means is output as a signal for the front left speaker;

wherein another signal at least containing the first virtual localization output of the virtual localization processing means is output as a signal for the front right speaker; and wherein a signal at least containing a second virtual localization output of the virtual localization processing means is output as a signal for the front center speaker.

In accordance with characteristics of the present invention, there is provided a surround signal processing device for virtually creating a surround left sound source and a surround right sound source through a front left speaker, a front center speaker and a front right speaker upon receipt of at least a front left channel signal, a front right channel signal and surround channel signals;

wherein resulting signals, one of the which is generated by performing a subtract processing on the front left channel signal and the front right channel signal and the other is generated by adding the surround channel signals, are supplied to a virtual localization processing means as a first monophonic signal and a second monophonic signal;

wherein signals at least containing a signal capable of being obtained by providing a delay in time substantially equal to that of the virtual localization processing means on the front left channel signal and a first virtual localization output of the virtual localization processing means, are output as a signal for the front left speaker;

wherein signals at least containing a signal capable of being obtained by providing a delay in time substantially equal to that of the virtual localization processing means on the front right channel signal and the first virtual localization output of the virtual localization processing means, are output as a signal for the front right speaker; and wherein signals at least containing a signal capable of being obtained by providing a delay in time substantially equal to that of the virtual localization processing means on a resulting signal generated by adding the front left channel signal and the front right channel signal and a second virtual localization output of the virtual localization processing means, are output as a signal for the front center speaker.

Also, in accordance with characteristics of the present invention, there is provided a surround signal processing device for virtually creating a surround left sound source and a surround right sound source through a front left speaker, a front center speaker and a front right speaker upon receipt of surround channel signals;

wherein the surround channel signals are supplied to a virtual localization processing means as a first monophonic signal and a second monophonic signal;

wherein a signal at least containing a front left channel signal and a first virtual localization output of the virtual localization processing means is output as a signal for the front left speaker;

wherein another signal at least containing a front right channel signal and the first virtual localization output of the virtual localization processing means is output as a signal for the front right speaker; and wherein a signal at least containing a second virtual localization output of the virtual localization processing means is output as a signal for the front center speaker.

Further, in accordance with characteristics of the present invention, there is provided a surround signal processing device for virtually creating a surround left sound source and a surround right sound source through a front left speaker, a front center speaker and a front right speaker upon receipt of at least a front left channel signal, a front right channel signal and surround left and surround right channel signals;

wherein resulting signals, one of the which is generated by performing a subtract processing on the front left channel signal and the front right channel signal and the other is generated by adding the surround left channel signal and the surround right channel signal, are supplied to a virtual localization processing means as a first monophonic signal and a second monophonic signal;

wherein signals at least containing a signal capable of being obtained by providing a delay in time substantially equal to that of the virtual localization processing means on the front left channel signal and a first virtual localization output of the virtual localization processing means, are output as a signal for the front left speaker;

wherein signals at least containing a signal capable of being obtained by providing a delay in time substantially equal to that of the virtual localization processing means on the front right channel signal and the first virtual localization output of the virtual localization processing means, are output as a signal for the front right speaker; and wherein signals at least containing a signal capable of being obtained by providing a delay in time substantially equal to that of the virtual localization processing means on a resulting signal generated by adding the front left channel signal and the front right channel signal and a second virtual localization output of the virtual localization processing means, are output as a signal for the front center speaker.

While the novel features of the invention are set forth in a general fashion, both as to organization and content. Other objects and features of the present invention will be more apparent to those skilled in the art on consideration of the accompanying drawings and following specification wherein are disclosed several exemplary embodiments of the invention with the understanding that such variations, modifications and elimination of parts may be made therein as fall within the scope of the appended claims without departing from the spirit of the invention.

BRIEF DESCRITION OF THE DRAWINGS

Figure 15:
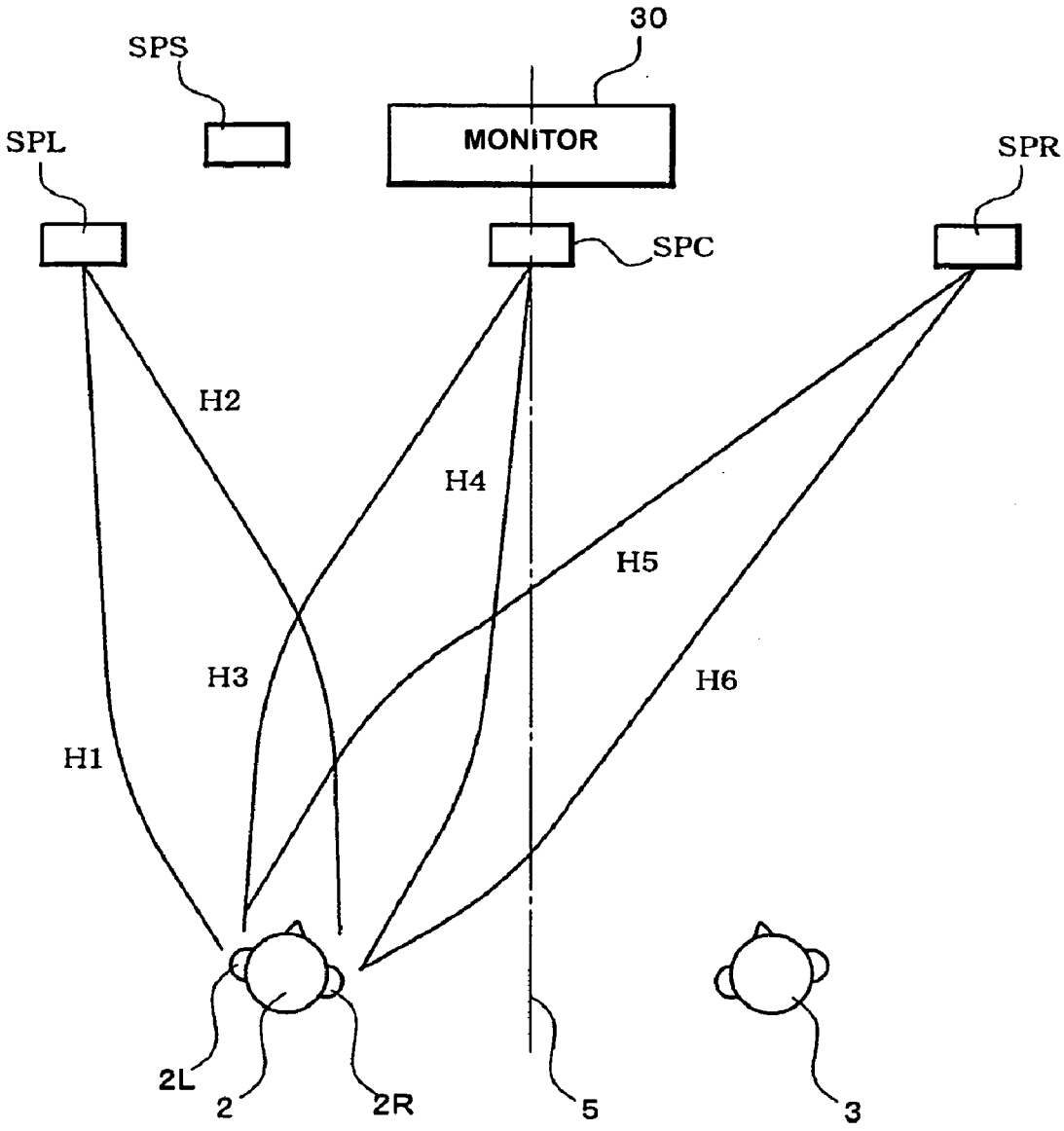

FIG. 15 is a schematic view illustrating the transfer functions when the listeners 2 and 3 look at a monitor 30.

Figure 16:
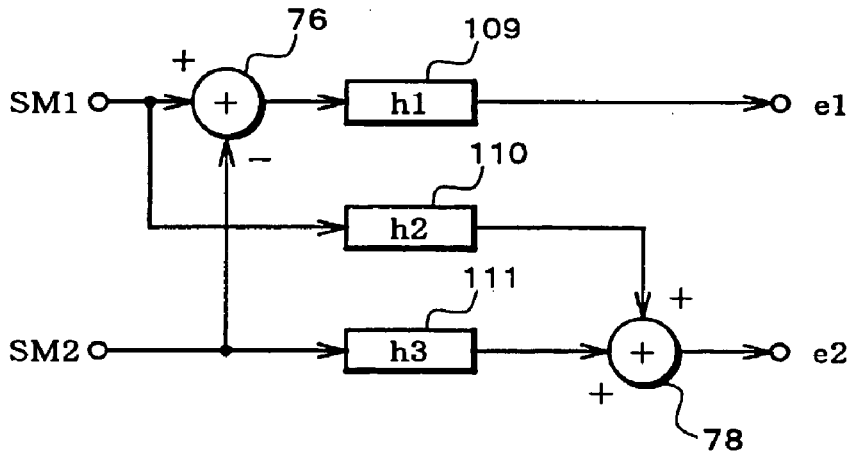

FIG. 16 is a signal-flow diagram illustrating virtual localization processing in another embodiment of the present invention.

Figure 17:
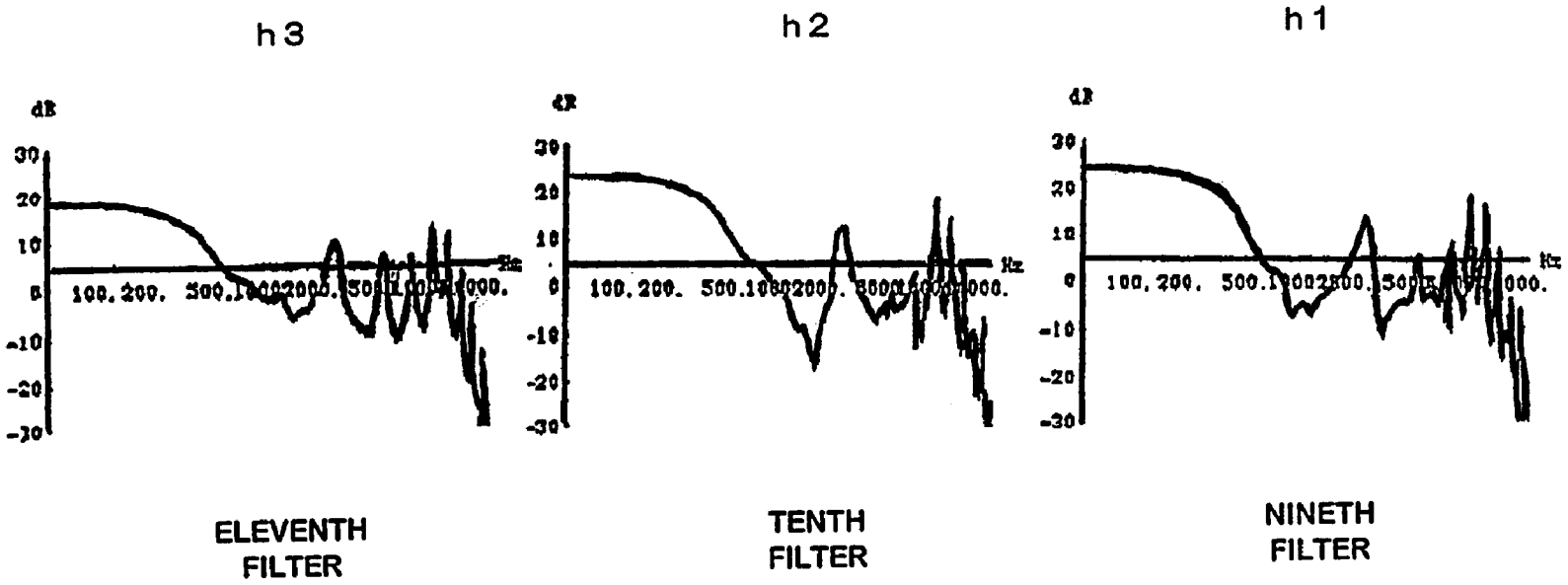

FIG. 17 shows graphs illustrating characteristics of the filters shown in FIG. 16.

Figure 18:
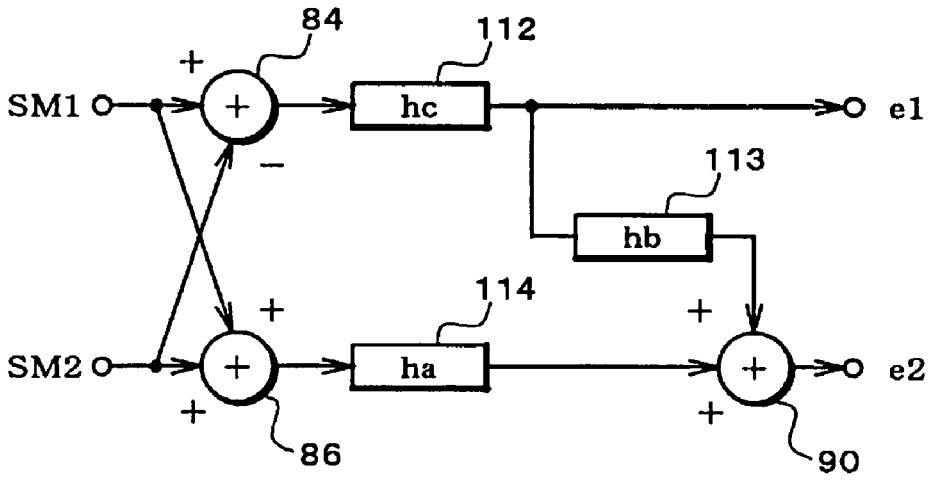

FIG. 18 is a signal-flow diagram illustrating virtual localization processing in another embodiment of the present invention.

Figure 19:
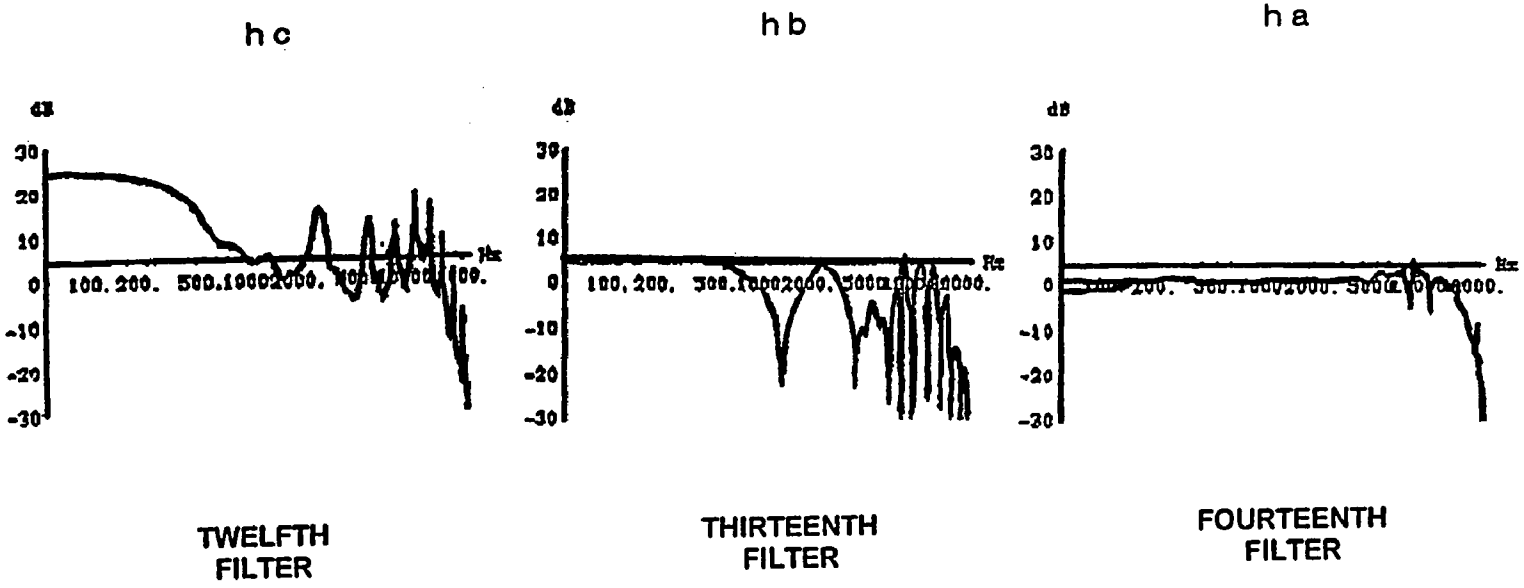

FIG. 19 shows graphs illustrating characteristics of the filters shown in FIG. 18.

Figure 20:
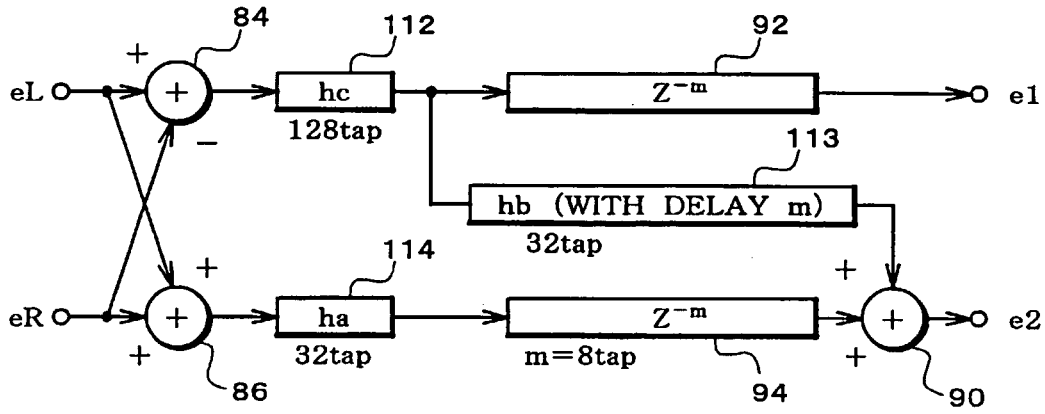

FIG. 20 is a signal-flow diagram illustrating virtual localization processing in another embodiment of the present invention.

Figure 21:
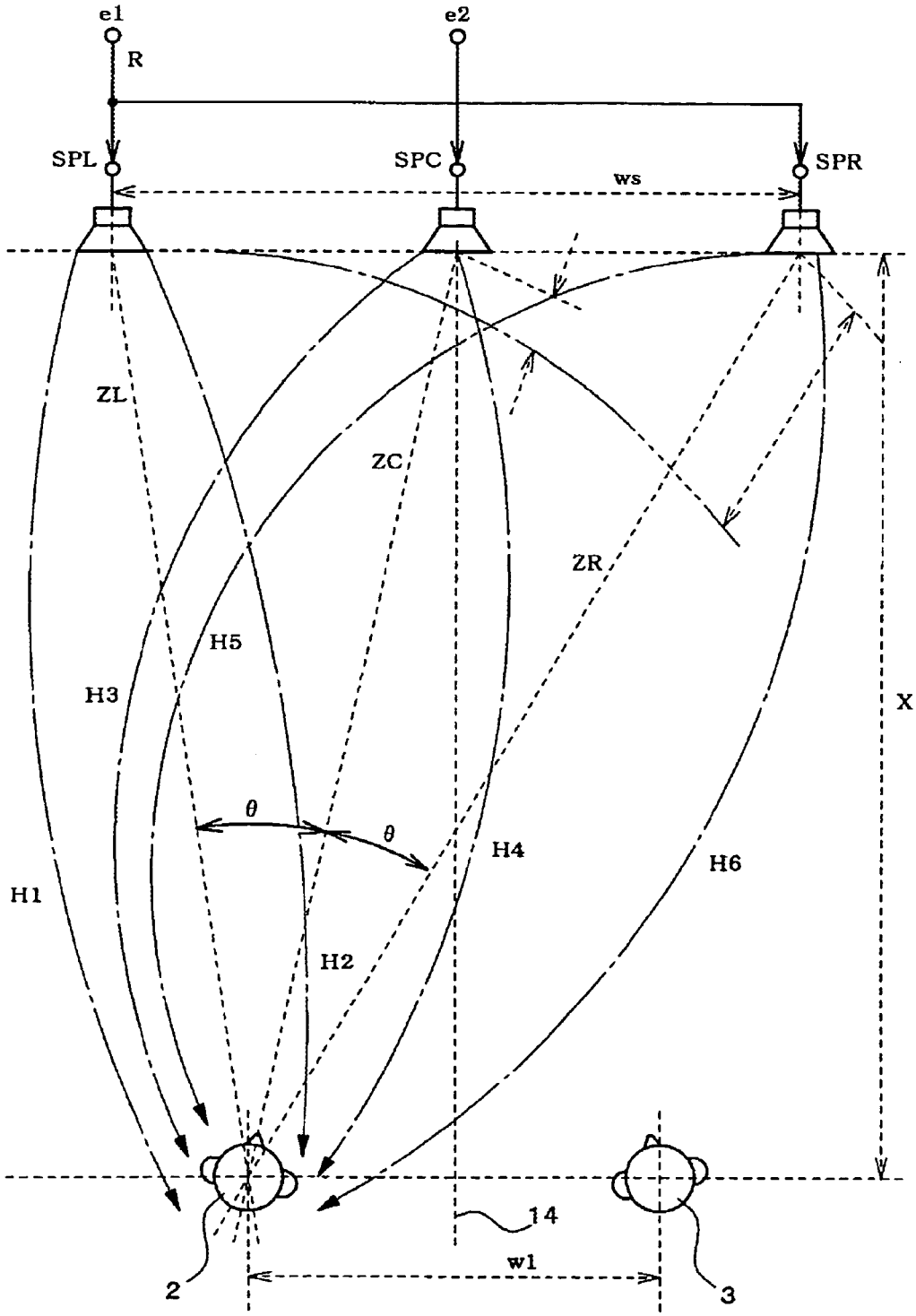

FIG. 21 is a schematic view illustrating another arrangement among the listeners 2 and 3, and the speakers, and transfer functions.

Figure 22:
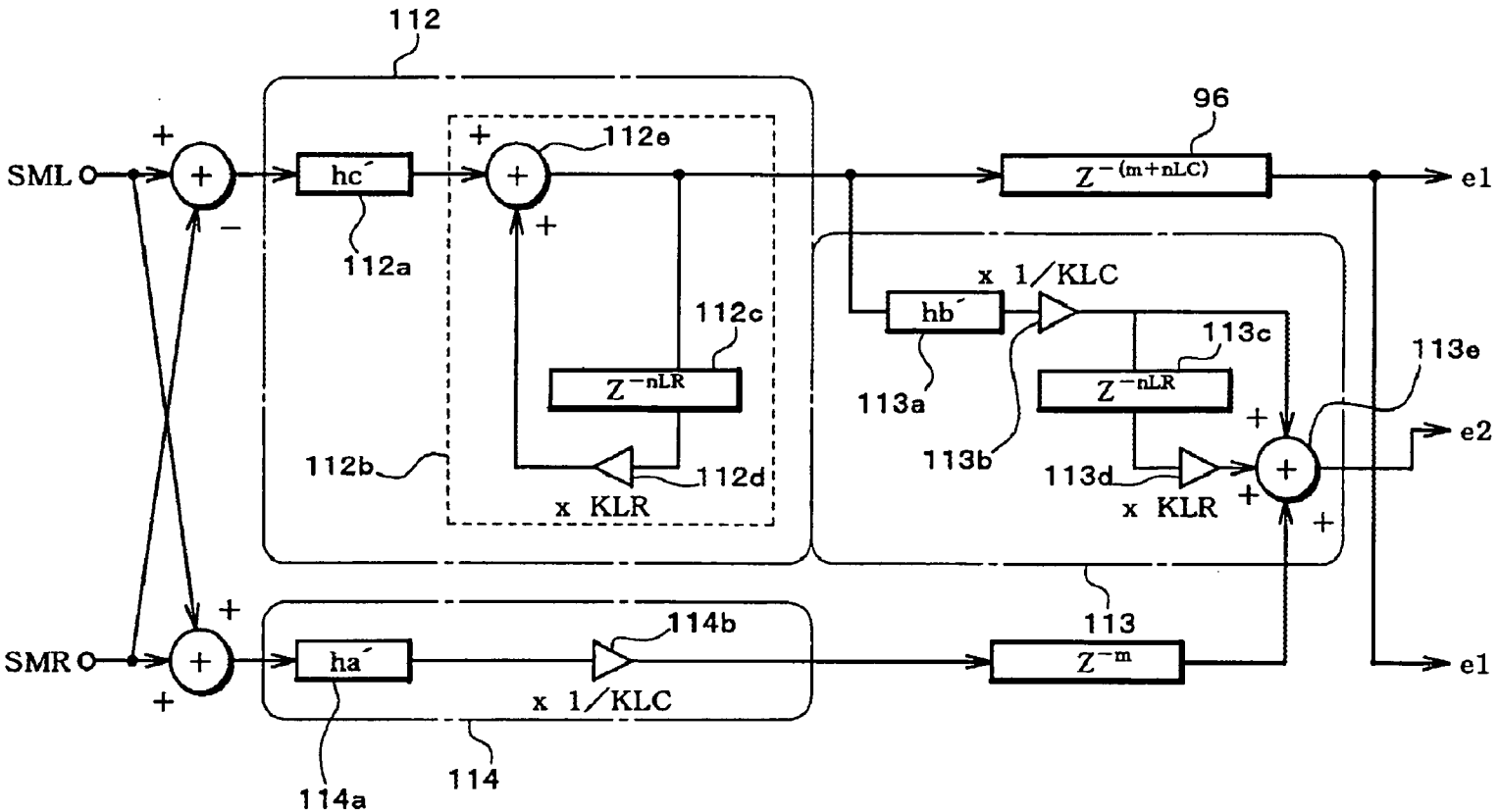

FIG. 22 is a signal-flow diagram illustrating virtual localization processing in another embodiment of the present invention.

Figure 23:
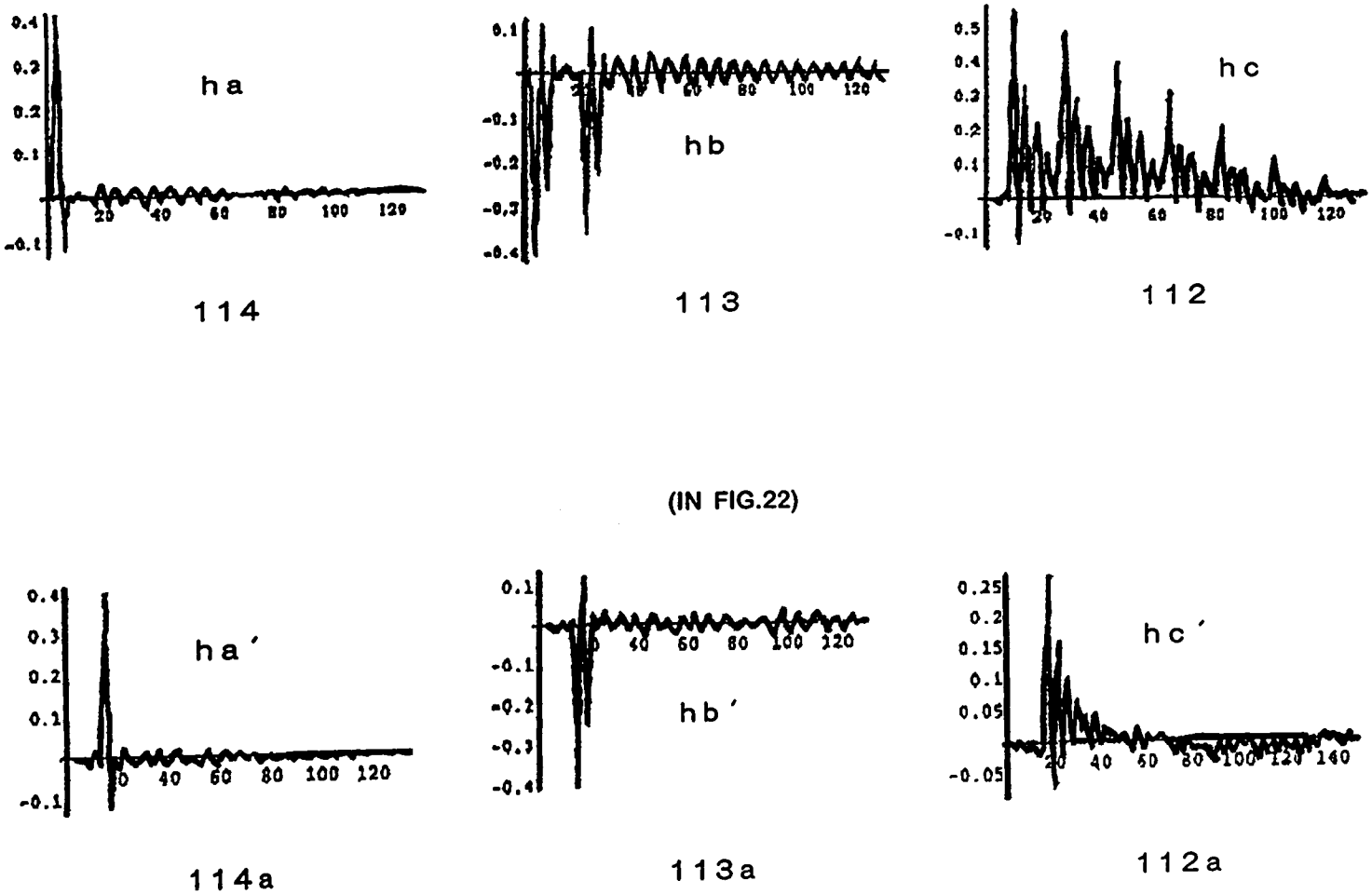

FIG. 23 shows graphs illustrating characteristics of the filters shown in FIG. 22.

Figure 24:
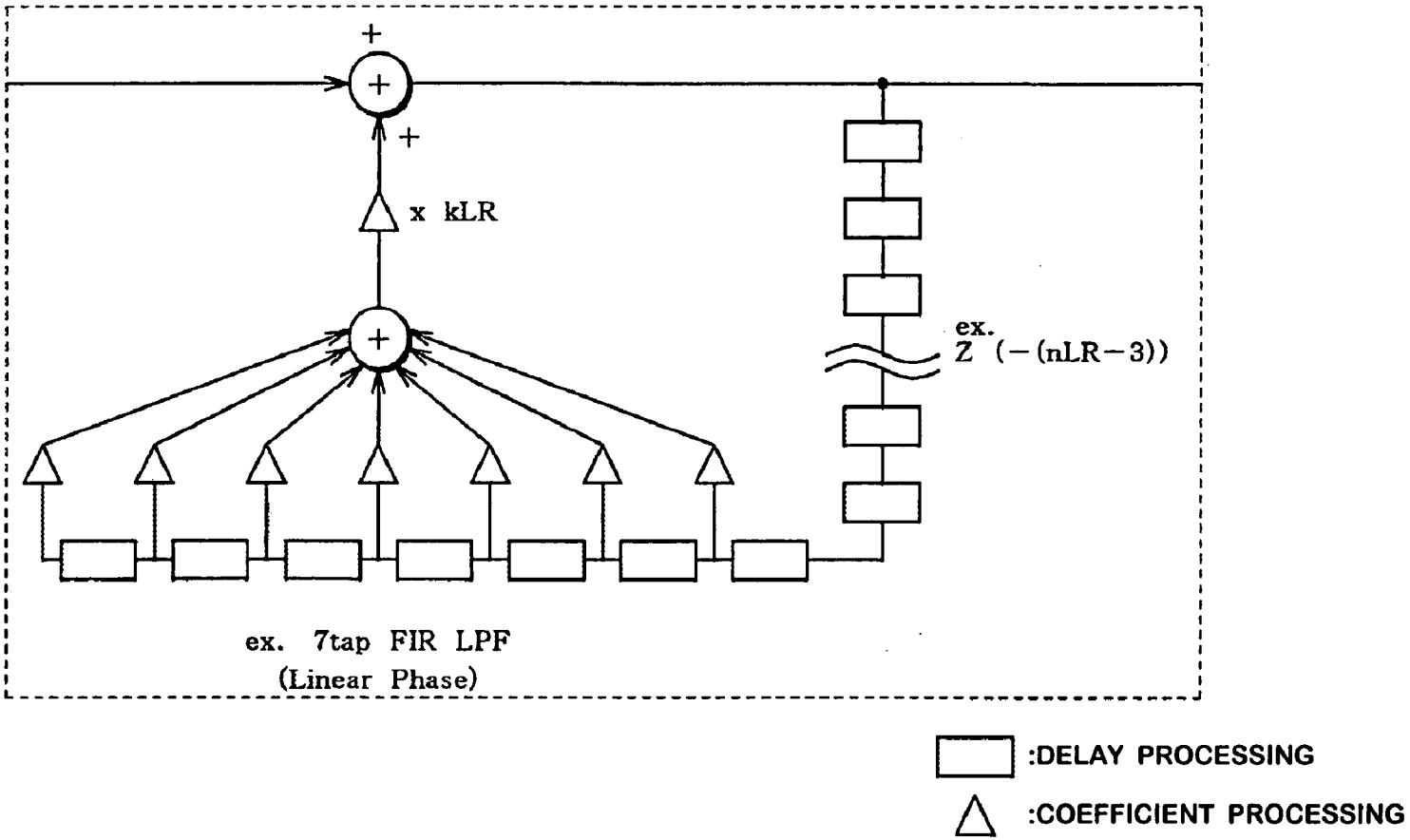

FIG. 24 is a diagram illustrating another embodiment of a delay attenuation feedback loop.

Figure 25A:
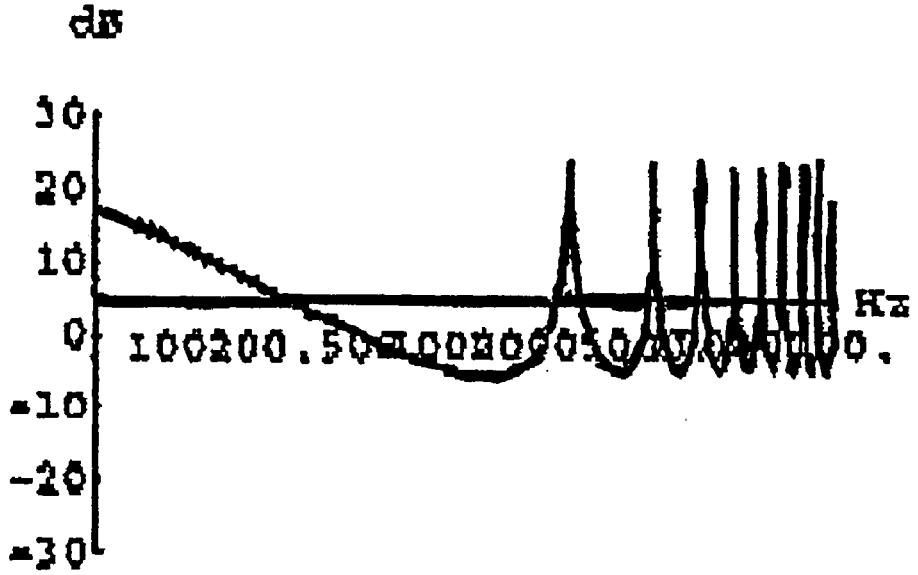
Figure 25B:
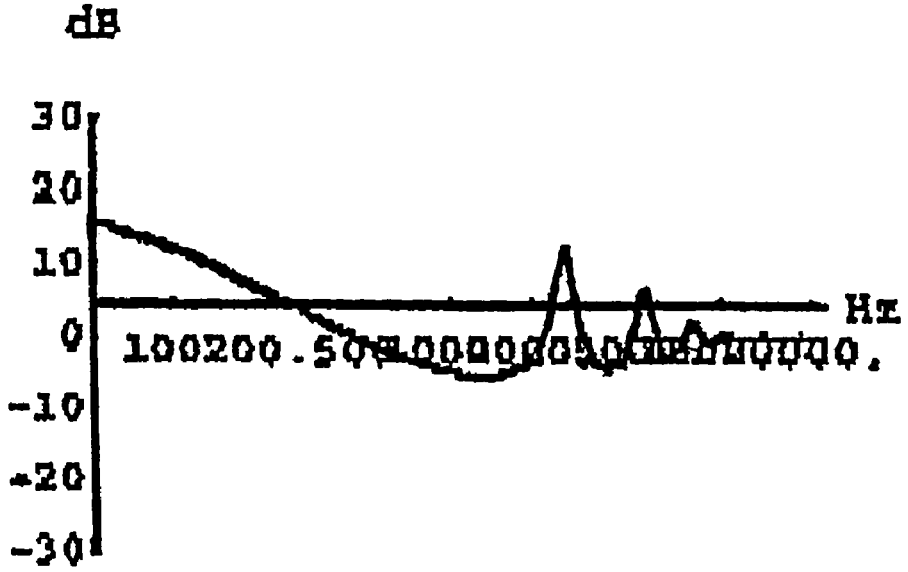

FIGS. 25A and 25B are graphs illustrating characteristics of the feedback loops shown in FIGS. 22 and 24.

Figure 26:
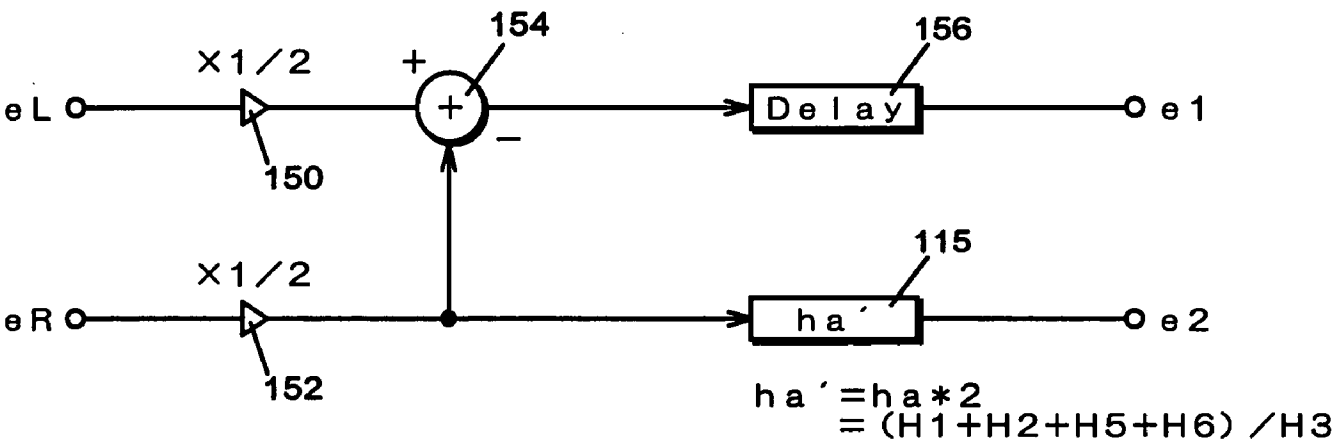

FIG. 26 is a signal-flow diagram illustrating virtual localization processing in another embodiment of the present invention.

Figure 27:
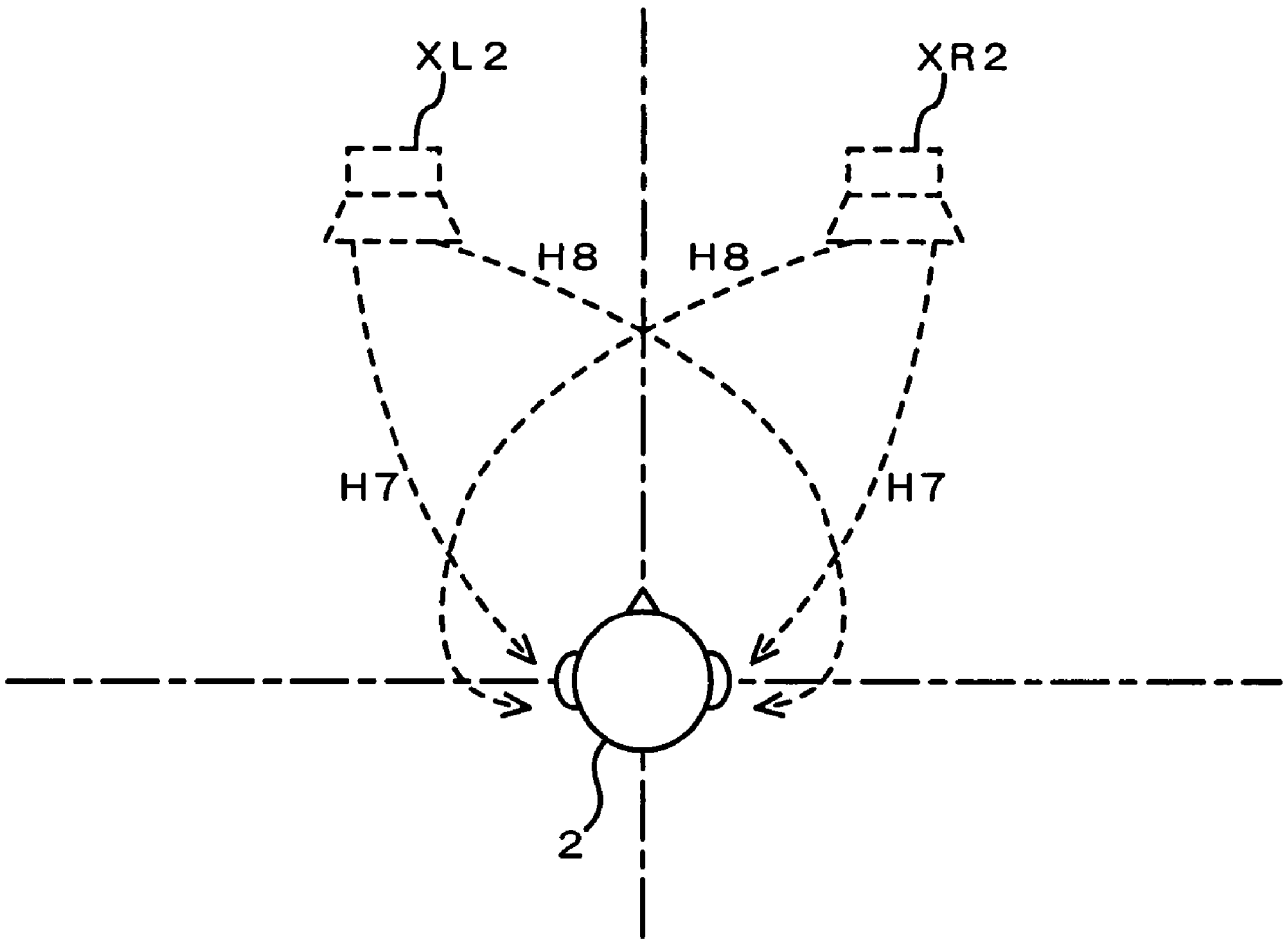

FIG. 27 is a schematic view illustrating a relationship in positions among the listener 2 and speakers XL2, XR2.

Figure 28:
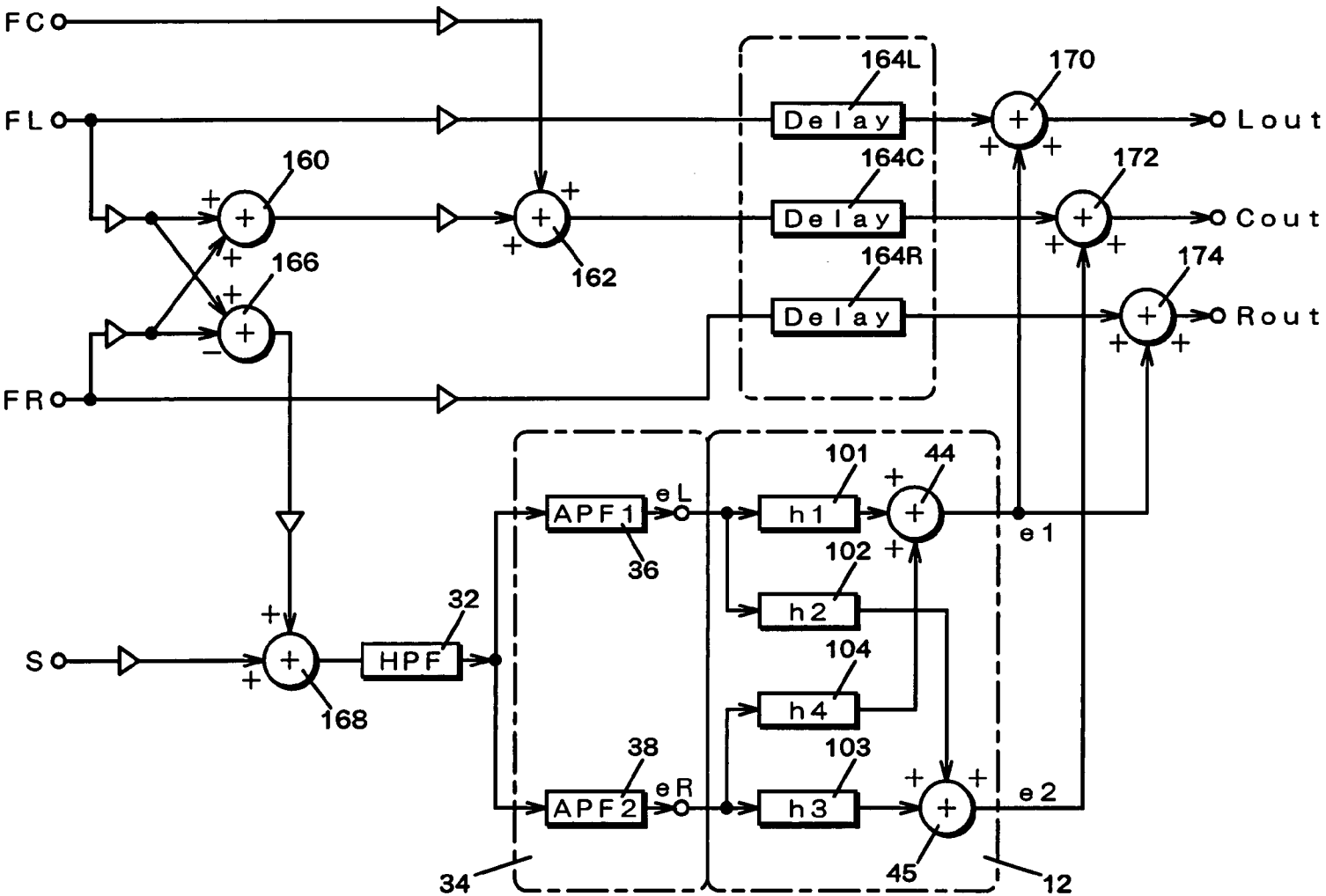

FIG. 28 is a signal-flow diagram illustrating virtual localization processing in another embodiment of the present invention.

Figure 29:
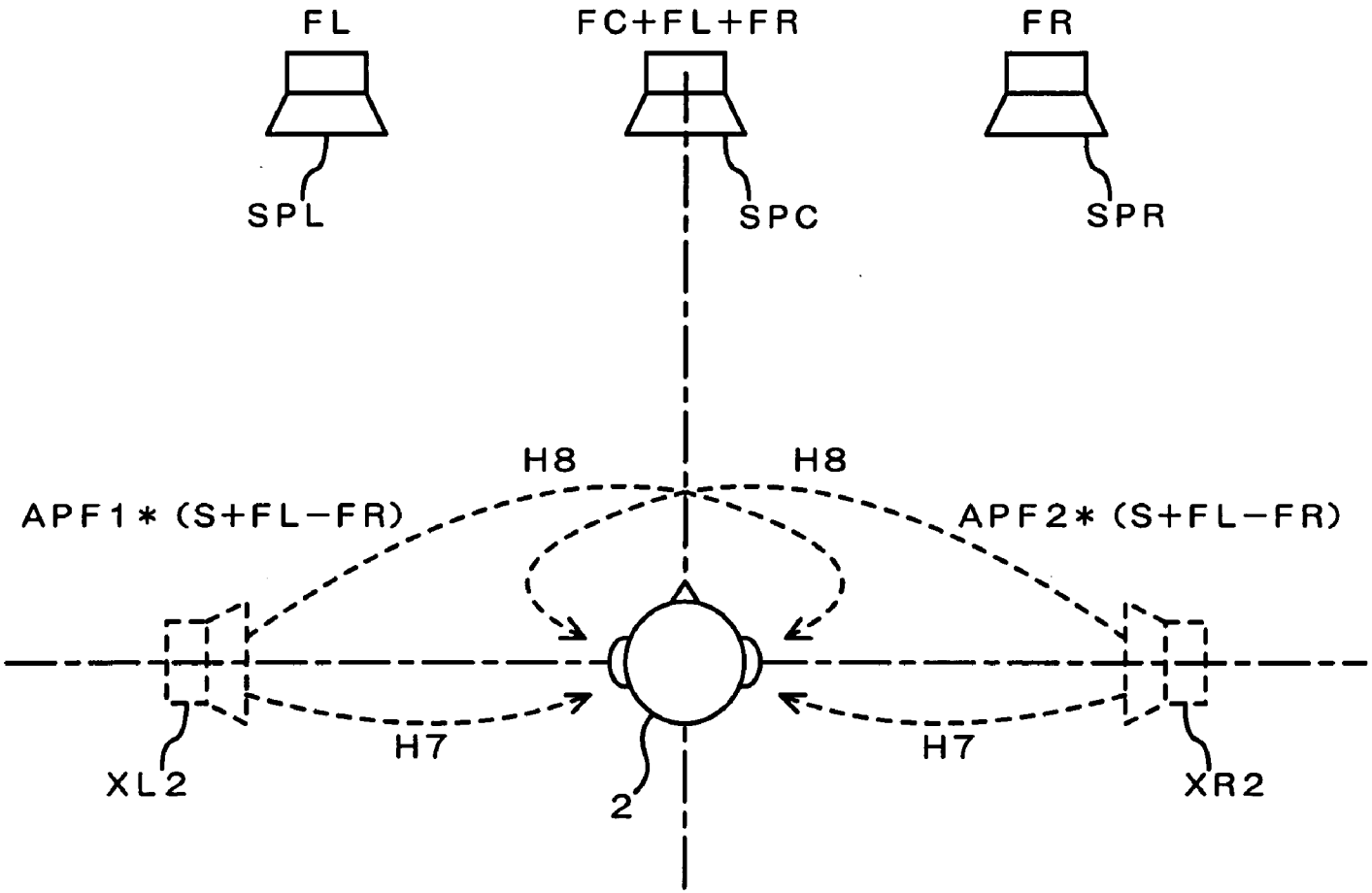

FIG. 29 is a schematic view briefly illustrating a relationship in positions among listener 2 and speakers XL2, XR2.

Figure 30:
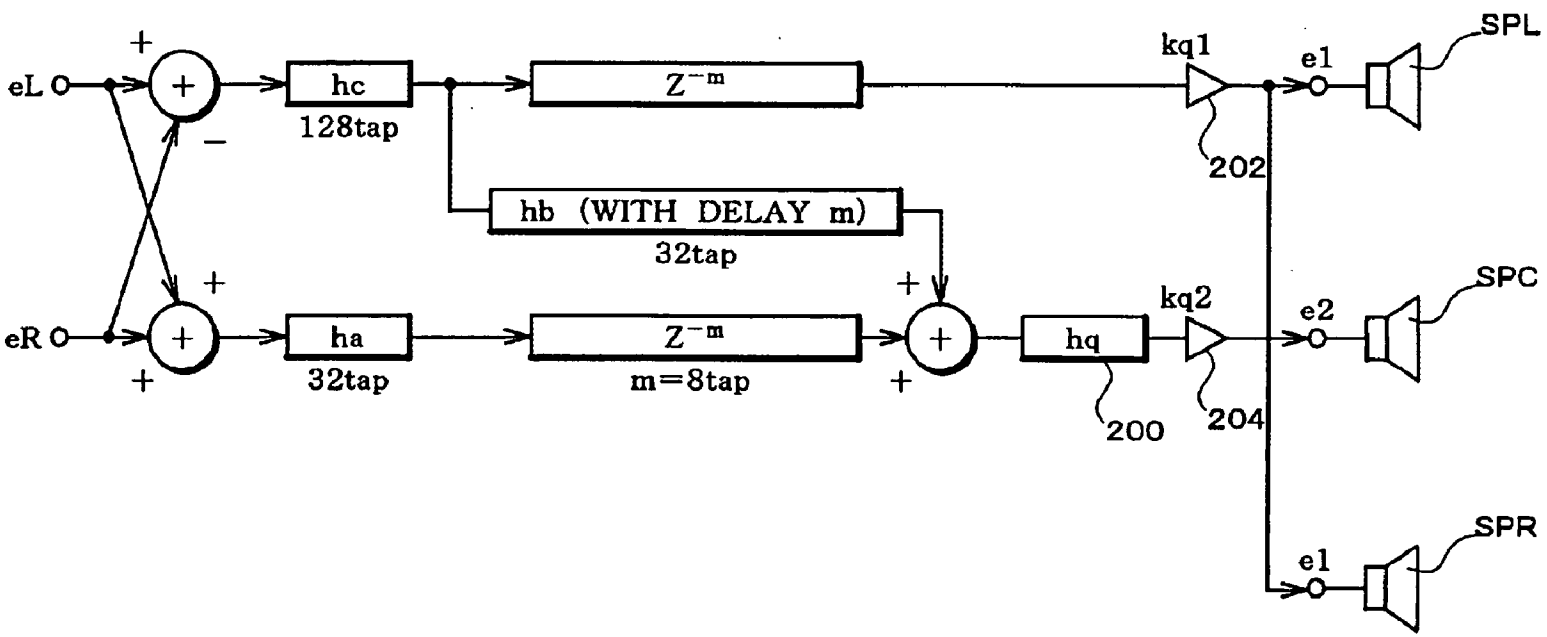

FIG. 30 is a signal-flow diagram illustrating virtual localization processing in another embodiment of the present invention.

Figure 31:
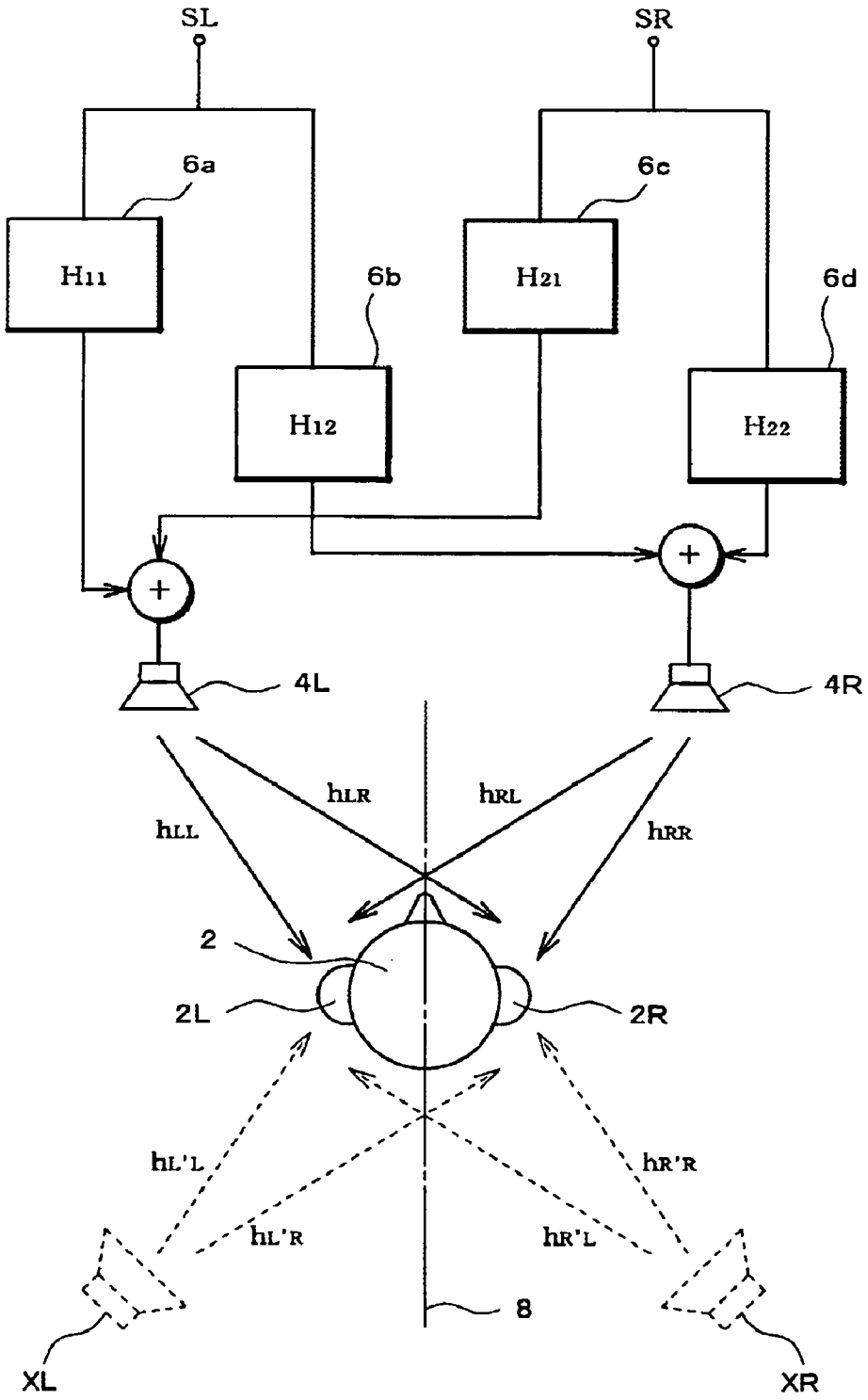

FIG. 31 is a schematic view illustrating the principle of virtual localization processing in a common surround signal processing system.

Figure 32:
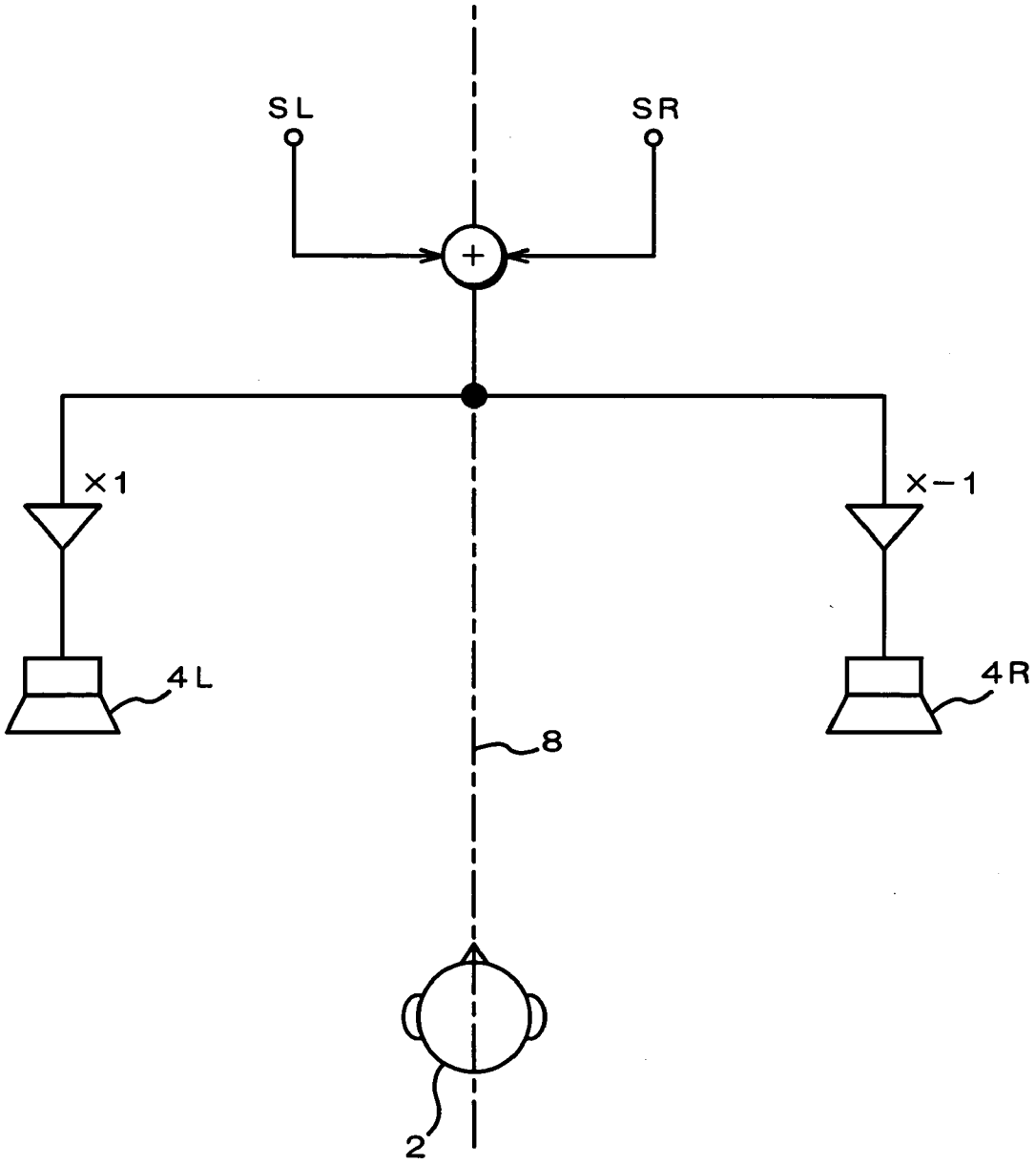

FIG. 32 is a schematic view illustrating the principle of a simplified method of surround signal reproduction in another common surround signal reproduction system.

DETAILED DESCRIPTION OF THE PREFERRED EMBODIMENTS

Figure 1:
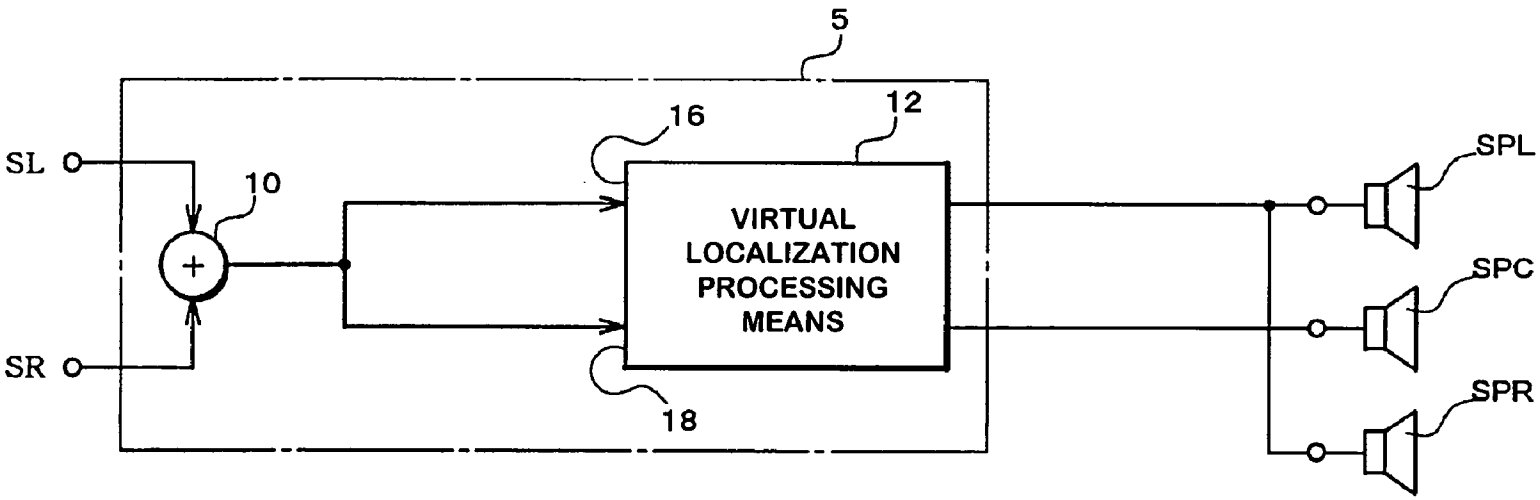
FIG. 1 is a block diagram illustrating the overall structure of a surround signal processing system according to an embodiment of the present invention.

FIG. 1 shows a block diagram illustrating the overall structure of a surround signal processing system according to an embodiment of the present invention. This system comprises a surround signal processing device 5, a front left speaker SPL, a front center speaker SPC, and a front right speaker SPR each connected to the outputs of the device.

Figure 2:
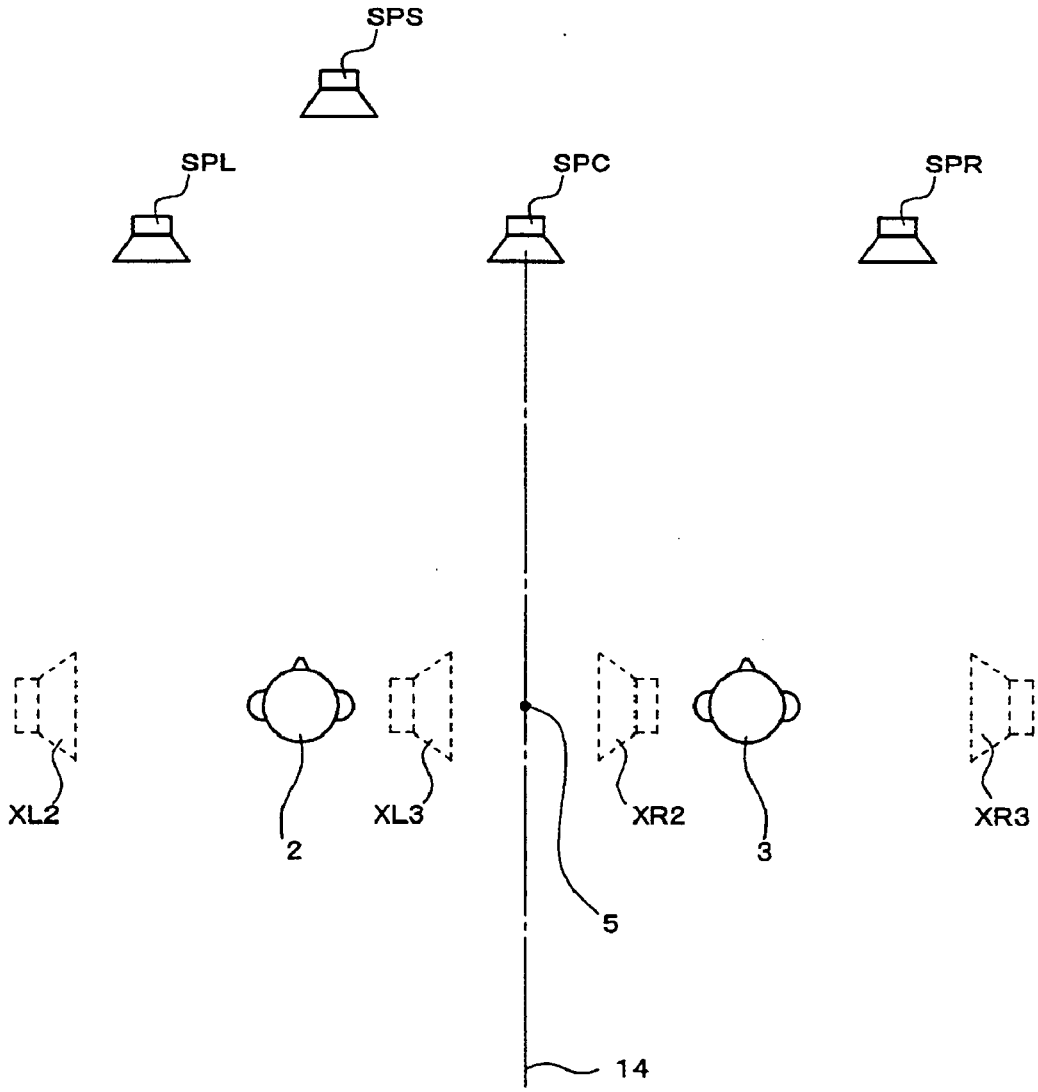
FIG. 2 is a schematic view illustrating an arrangement among listeners 2 and 3, and speakers.

FIG. 2 shows a schematic view illustrating an arrangement among listeners, and the speakers in this embodiment. Both the front left speaker SPL, the front center speaker SPC are arranged at positions front left and front right to a first listener 2 respectively. The front center speaker SPC, the front right speaker SPR are arranged at positions front left and front right to a second listener 3 respectively.

The front left speaker SPL and the front right speaker SPR are symmetrically arranged with respect to the central axis 14 extending between the front center speaker SPC and a point 5 located at an intermediate position between the listeners 2 and 3. Further, the listeners 2 and 3 sit symmetrically with respect to the central axis 14.

As depicted in FIG. 1, both a surround left channel signal SL and a surround right channel signal SR are mixed with an add means 10. In other words, the inputted signals are monauralized when both the surround left channel signal SL and the surround right channel signal SR are provided as stereophonic signals. Monophonic signals are also obtained when both the surround left channel signal SL and the surround right channel signal SR are provided as monophonic signals.

A virtual localization processing means 12, performing virtual localization processing to signals inputted to a first input 16 and a second input 18 and providing the resulting signals to the front left speaker SPL, the front center speaker SPC and the front right speaker SPR, is used for creating virtual sound sources at the left (as a virtual surround left sound source XL2 shown in FIG. 2) and the right (as a virtual surround right sound source XR2 shown in FIG. 2) to the listener 2 each reproducing sound field according to the input signal of the first input 16 and that of the second input 18.

A monophonic surround signal output from the add means 10 is respectively provided to both the first input 16 and the second input 18 as a first monophonic signal and a second monophonic signal.

One of the resulting signals outputted from the processing means 12 is supplied to both the front left speaker SPL and the front right speaker SPR as a first virtual localization output, and the other resulting signal outputted therefrom is supplied to the front center speaker SPC as a second virtual localization output. In this way, both the virtual surround left sound source XL2 and the virtual surround right sound source XR2 are respectively generated at the right and the left to the listener 2 (see FIG. 2). Consequently, an advantage from which the listener 2 feels that the reproduction of the first monophonic signal and the second monophonic signal is performed respectively through the left sound source XL2 and the right sound source XR2.

Similarly, both a virtual surround left sound source XL3 and a virtual surround right sound source XR3 are respectively generated at the left and the right to the listener 3. From a view point of the listener 3, however, an advantage from which the listener 3 feels that the reproduction of the second monophonic signal and the first monophonic signal is performed respectively through the left sound source XL3 and the right sound source XR3 because the listeners 2 and 3 sit symmetrically with respect to the front center speaker. In other words, stereophonic sound fields reproduced with the virtual surround sound sources are in reverse. However, no substantial drawbacks caused by the reversal are observed because monophonic signals are reproduced as the surround signals in this embodiment.

From this approach, an advantage so called surround-effect through the virtual sound sources can be provided to both the listeners 2, 3 who sit next to each other under side-by-side basis. Similar advantage can be expected even when further listeners are involved either at front or rear side of the listeners 2, 3 (that is, equal to or more than three listeners are involved).

Incidentally, the listener has an unnatural feeling as if sound image was localized in the head when signals such as monophonic signals having a large correlation are reproduced from both sides of the listener. In order to cancel that feeling, the correlation between the first monophonic signal and the second monophonic signal may be reduced by supplying these signals to the reduce correlation means 11 as depicted in FIG. 3C.

Figure 3A:
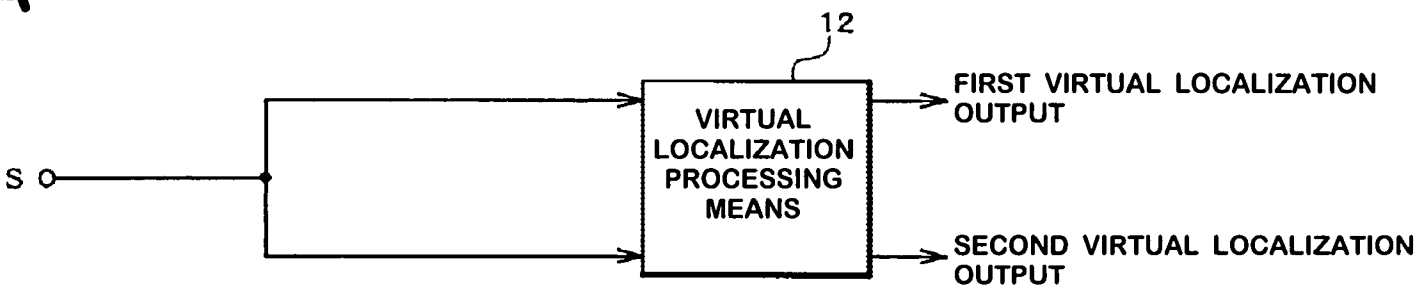
FIGS. 3A to 3C are schematic views illustrating processing performed when surround signals are provided as input signals in monophonic format.
Figure 3B:
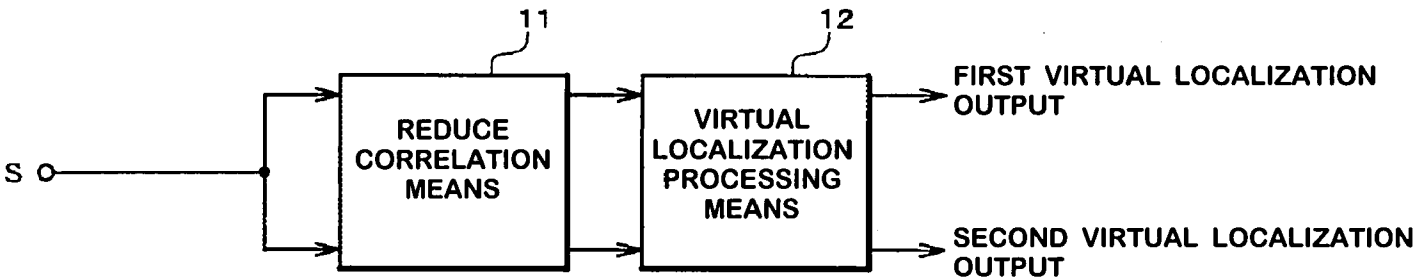
Figure 3C:
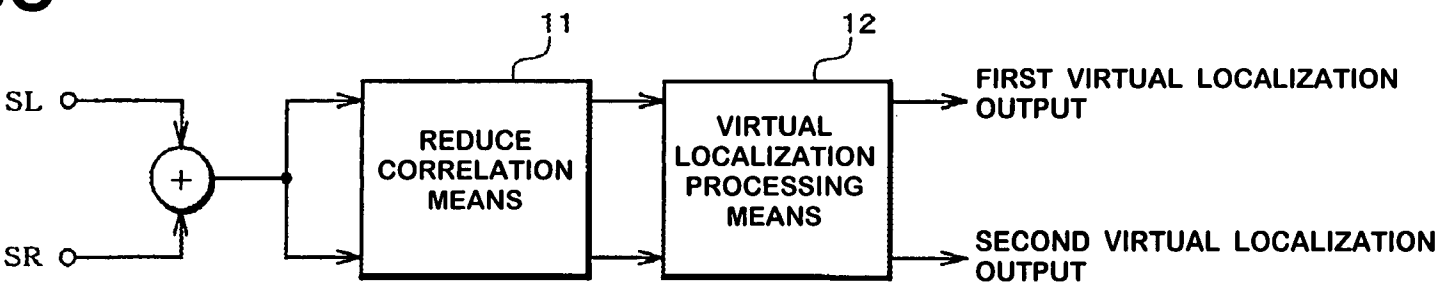

Another structure wherein the add means 10 depicted in FIG. 1 is omitted may be employed if both the surround signals are provided as one monophonic signal as shown in FIG. 3A. In other words, both the first monophonic signal and the second monophonic signal may directly be obtained from the single monophonic signal provided thereto. Alternatively, these monophonic signals may also be obtained by providing the reduce correlation means 11 as shown in FIG. 3B.

Figure 4:
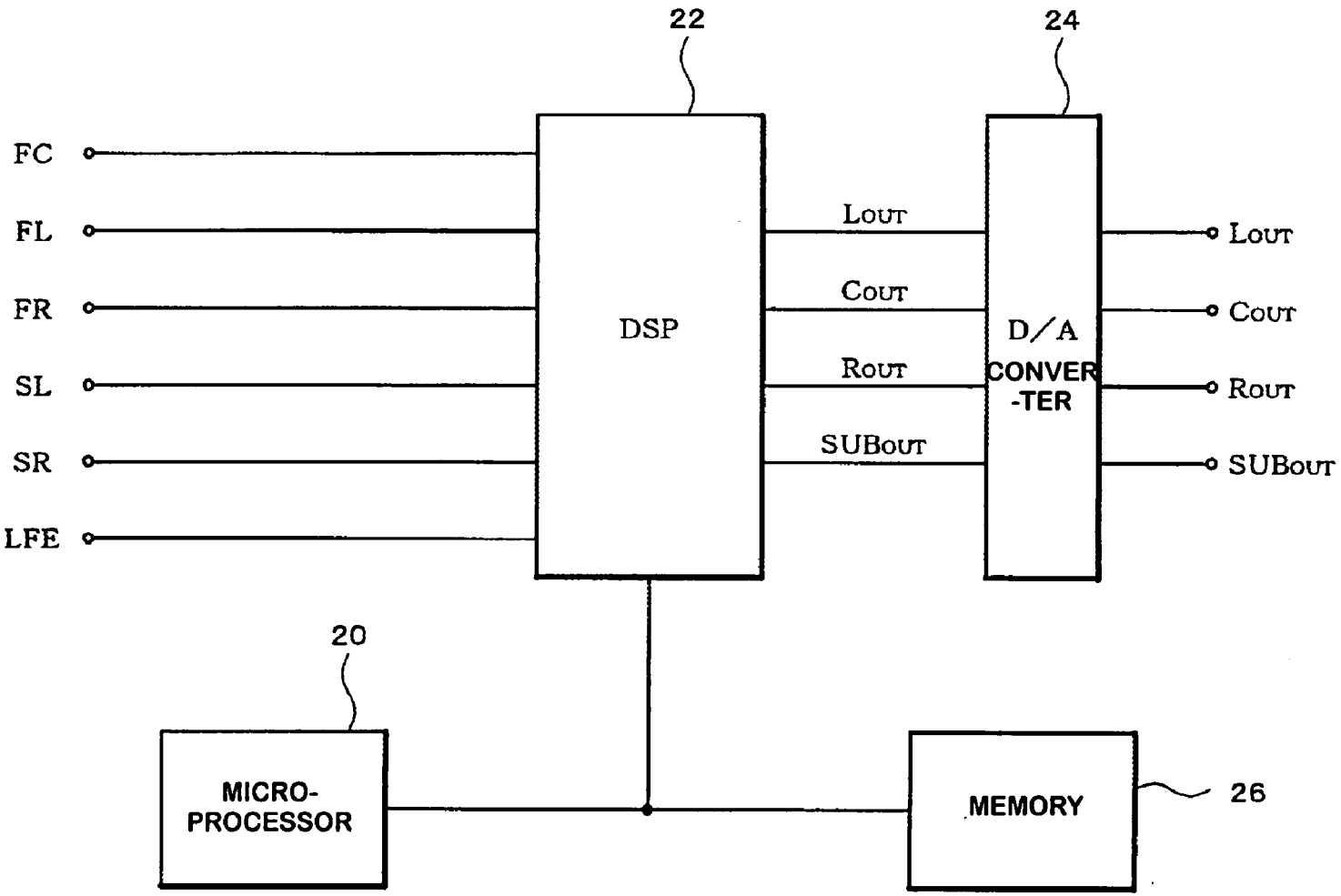
FIG. 4 is a block diagram illustrating a hardware structure of the surround signal processing system using a digital signal processor (DSP).

FIG. 4 shows a block diagram illustrating a hardware structure of the surround signal processing system using a DSP 22. The device is used for reproducing input signals such as a front left channel signal FL, a center channel signal FC, a front right channel signal FR, a surround left channel signal SL, a surround right channel signal SR, a low frequency signal LFE with a three speakers SPL, SPC and SPR, and a sub-woofer speaker SPS.

The signals FL, FC, FR, SL, SR and LFE are obtained by performing the following procedures: digitizing one of digital bit stream signals encoded under surround-encoding manner and analog signals with an analog/digital (A/D) converter, and decoding such digitized data inputted to a multi-channel surround decoder (not shown). These signals are supplied to the DSP 22. The multi-channel surround decoder may be built-in the DSP 22 or in separate therefrom.

The DSP 22 carries out a series of processings to the digital data such as addition, subtraction, filtering, delay and the like in accordance with program(s) stored in a memory 26 and generates signals such as signals $L_{OUT}$, $C_{OUT}$, $R_{OUT}$ and $SUB_{OUT}$ for the front left speaker, the front center speaker, the front right speaker and the sub-woofer speaker. These signals are converted into analog signals with a D/A converter 24 and supplied to the speakers SPL, SPC, SPR and SPS. Installation of the program(s) into the memory 26 is carried out with a microprocessor 20. The program(s) may be stored in advance in a read-only-memory (ROM) and the like, or be installed from other storing medium(s) such as CD-ROMs or the like.

In this embodiment, the description will be made under an assumption of arranging the speakers SPL and SPR as well as the listeners 2 and 3 symmetrically with respect to the central axis 14 as depicted FIG. 5. However, the sub-woofer SPS may be arranged at any places due to less directivity and long wavelength of the sound outputted therefrom.

Furthermore, a display monitor 30 for displaying images is arranged at the front center, and the front center speaker SPC is built in the monitor 30. It is, of course, the front center speaker SPC may also be provided separately from the monitor 30. In addition, at least one of the speakers SPL, SPC, SPR and SPS may also be built in the monitor 30.

Figure 6:
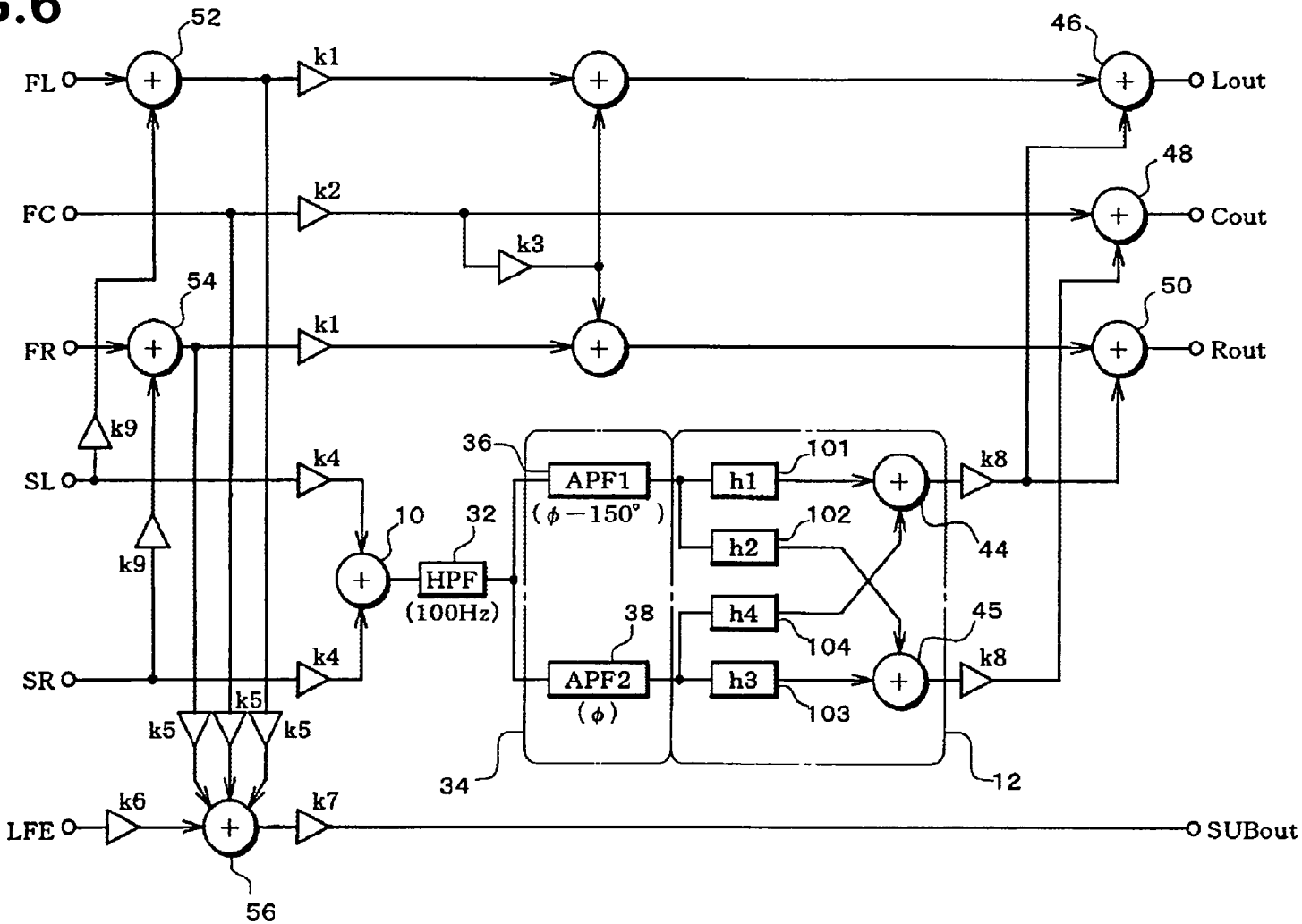
FIG. 6 is a signal-flow diagram illustrating the surround signal processing system realized by utilizing a DSP.

FIG. 6 shows a series of processings performed by the DSP 22 according to the program(s) stored in the memory 26 in a signal-flow diagram. In this embodiment, the surround left channel signal SL and the surround right channel signal SR are mixed with the add means 10 so as to be monauralized. The output of the add means 10 is filtered with a high-pass filter (HPF) 32 to cut surplus low frequency components, then the resulting signal is branched to a first monophonic signal and a second monophonic signal and supplied to the reduce correlation means 34.

Processing for decreasing the correlation between the first monophonic signal and the second monophonic signal is carried out with the reduce correlation means 34. The listener has an unnatural feeling as if sound image was localized in the head if signals having large correlation such as monophonic signals are reproduced from both besides the listener. In order to solve the problem, a certain phase shift processing so as to decrease the correlation between the first monophonic signal and the second monophonic signal, is carried out in this embodiment. In a theoretical point of view, the correlation therebetween can be made to zero if the phase shift between the signals is in 90 degrees. However, sound image is apt to be localized in the direction of the channel whose phase relatively progresses if a 90-degree phase shift is conducted. As a consequence, the relative phase difference is preferably in a range of 140 degrees to 160 degrees. In this way, sound field just as enveloping the listener can be created thereabout. Practically, the phase of 150 degrees is employed.

Figure 7A:
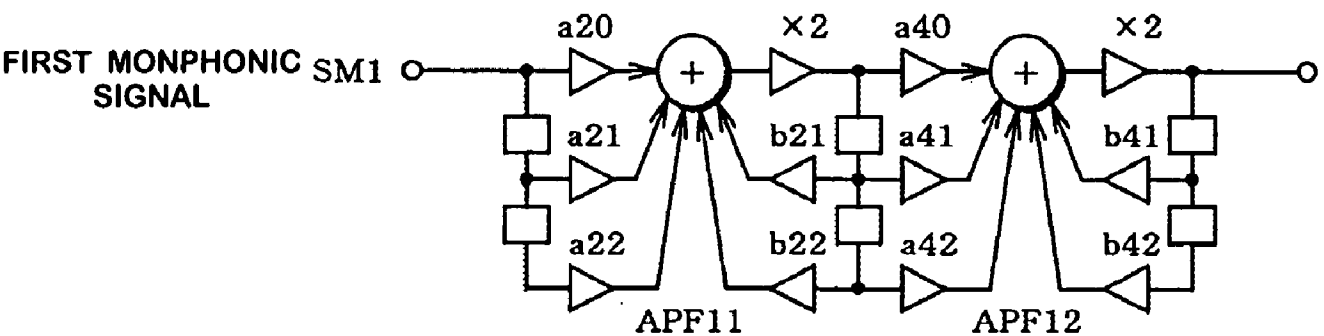
FIGS. 7A and 7B are views illustrating examples of all pass filters.
Figure 7B:
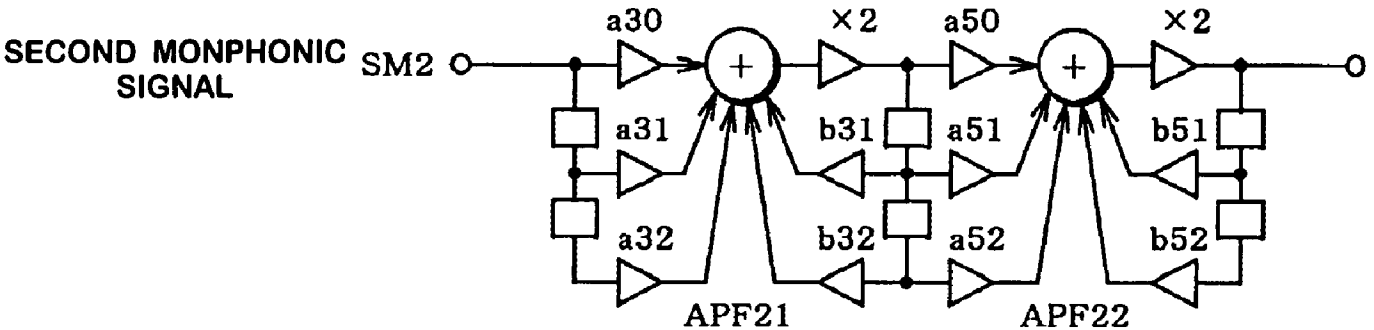
Figure 8:
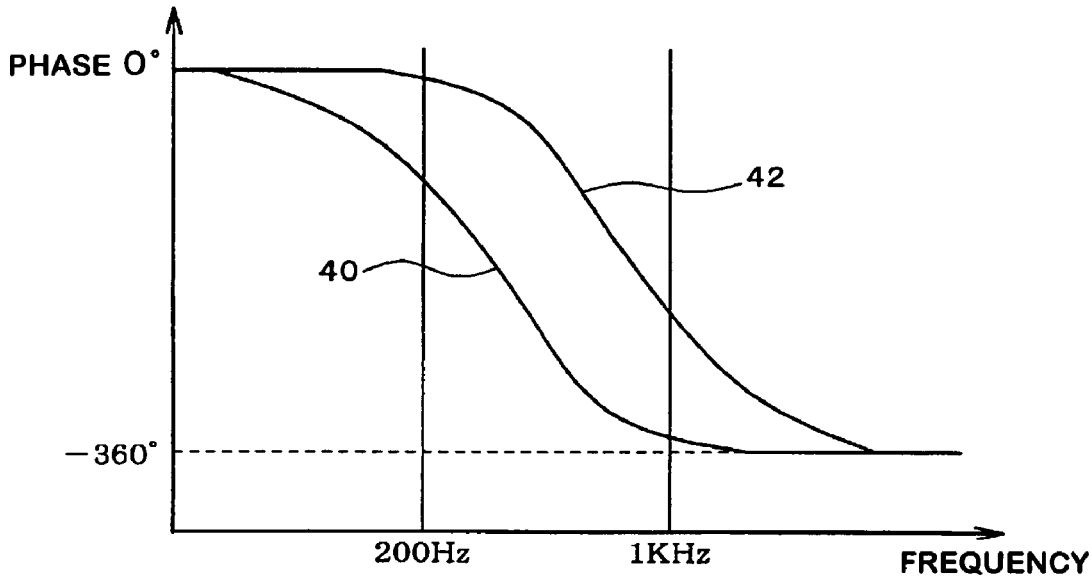
FIG. 8 is a graph illustrating phase difference characteristics of the all pass filters.

In this embodiment, two of all-pass filters (APF) 36 and 38 are used to perform the phase shift processing. Structural examples of the APFs 36 and 38 are depicted respectively in FIGS. 7A and 7B, and the qualitative characteristics in phase of APFs 36 and 38 are respectively shown as curves 40 and 42 in FIG. 8.

Figure 9:
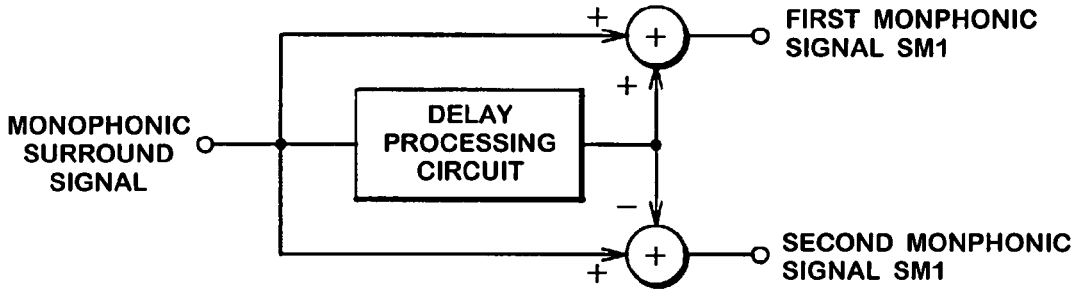
FIG. 9 is a signal-flow diagram illustrating reduce correlation performed using a comb type filter.

Although, the reduce correlation processing is performed by the phase shift control in this embodiment, a processing alternatively dividing a monophonic signal into two channels with respect to each frequency component of predetermined width by using a comb type filter so as to virtually reproduce stereophonic sound may be carried out as depicted in FIG. 9. Furthermore, another approach performing a pitch shift processing so as to reduce the correlation such as THX system can be used.

The first monophonic signal and the second monophonic signal thus processed under the reduce correlation are supplied to the processing means 12. In this embodiment, the processing means 12 is composed of a first filter 101, a second filter 102, a third filter 103, a fourth filter 104, and both adders 44 and 45. The first monophonic signal and the second monophonic signal are respectively supplied to both the first filter 101 and the second filter 102 and both the third filter 103, the fourth filter 104. The outputs from the first filter 101 and the fourth filter 104 are added with the adder 44 and then outputted as a first virtual localization output. The outputs from the second filter 102 and the third filter 103 are also added with the adder 45 and then outputted as a second virtual localization output.

Here, transfer functions h1, h2, h3 and h4 of the respective filters 101, 102, 103 and 104 are determined as the followings.

Figure 5:
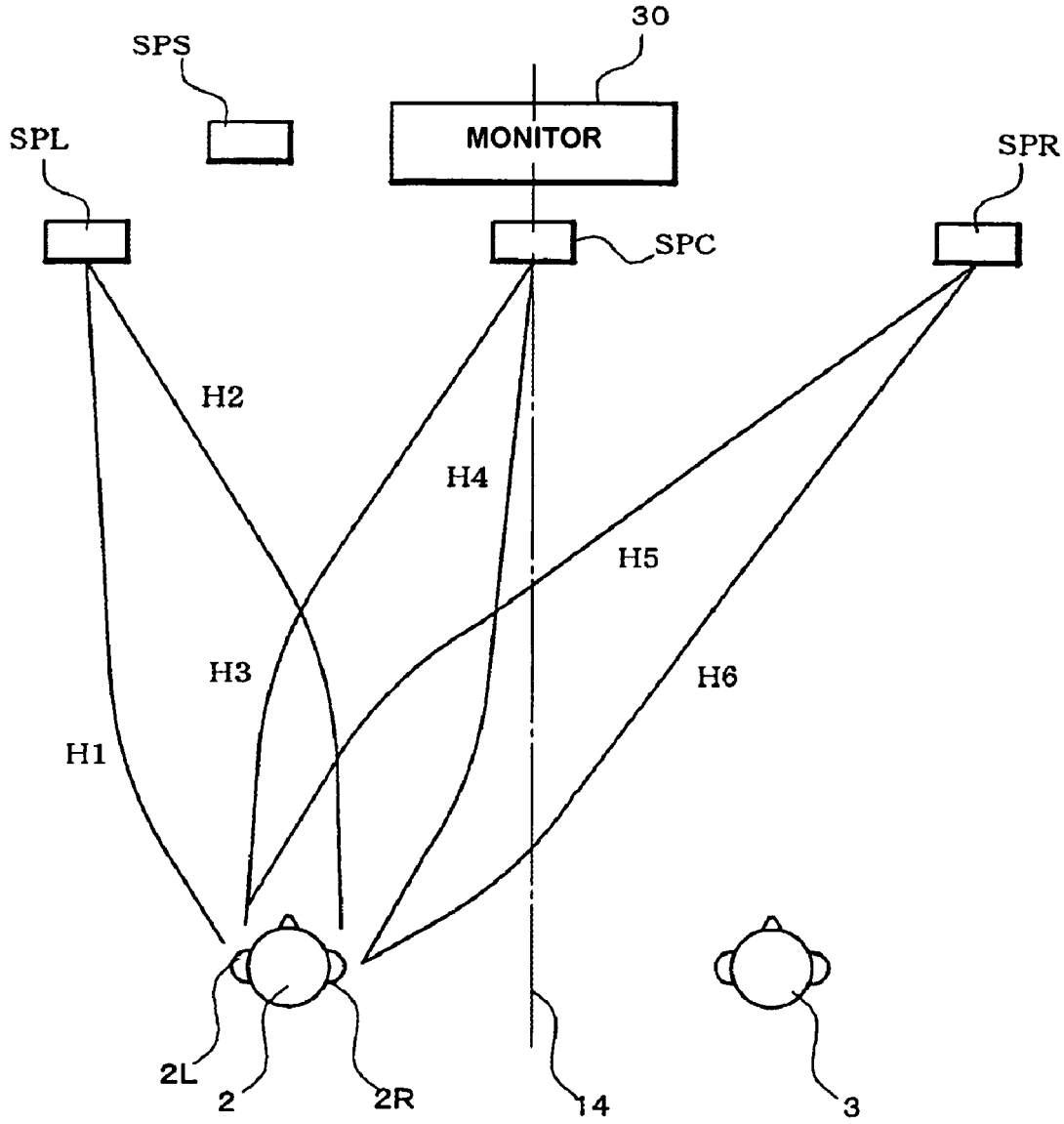
FIG. 5 is a schematic view illustrating another arrangement among the listeners 2 and 3, and the speakers, and transfer functions.

As shown in FIG. 5, H1 is a transfer function from the front left speaker SPL to the left ear 2L of the listener 2, H2 is a transfer function from the front left speaker SPL to the right ear 2R of the listener 2, H3 is a transfer function from the front center speaker SPC to the left ear 2L of the listener 2, H4 is a transfer function from the front center speaker SPS to the right ear 2R of the listener 2, H5 is a transfer function from the front right speaker SPR to the left ear 2L of the listener 2, and H6 is a transfer function from the front right speaker SPR to the right ear 2R of the listener 2. Further, as shown in FIG. 29 described later, H7 is defined as a transfer function from both the virtual surround left sound source XL2 to the left ear 2L the listener 2 and the virtual surround right sound source XR2 to the right ear 2R of the listener 2, and H8 is defined as a transfer function from both the virtual surround left sound source XL2 to the right ear 2R the listener 2 and the virtual surround right sound source XR2 to the left ear 2L of the listener 2. In addition, signals for the speakers SPL and SPR, a signal for the speaker SPS are respectively defined as e1 and e2, and signals at the left ear 2L of the listener 2 and that at right ear 2R of the listener 2 are also defined as VL and VR respectively. For the listener 3, the opposite side of ear and that of speaker are used to define the functions and that the signals described above.

According to the description in the above, signals VL and VR are represented by the following equations:

On the contrary, in order to reproduce a first monophonic signal eL and a second monophonic signal eR both of which had been processed under the reduced correlation with the sound sources XL2 and XR2 respectively localized at the left and the right to the listener 2, the signals VL and VR need to satisfy the following equations:

$$VL=H7\cdot eL+H8\cdot eR$$

$$VR=H8\cdot eL+H7\cdot eR.$$

In order to realize the reproduction by using the four filters 101, 102, 103 and 104 depicted in FIG. 6, transfer functions h1, h2, h3 and h4 responding to the four filters 101, 102, 103 and 104 can be determined as the following equations under an assumption that the signals VL and VR described above are equal to each other:

Although, another virtual surround sound sources XL3 and XR3 in which signals are supplied to the opposite sides are reproduced for the listener 3, the listener 3 never has an unnatural feeling as if the stereophonic sound fields are in reverse because the surround signals are supplied as monophonic signals.

Moreover, the virtual localization processing using the filters can substantially be realized by canceling cross-talk from the sound sources XL2 to the right ear 2R of the listener 2 and that from the sound sources XR2 to the left ear 2L of the listener 2. In order to use these filters as cross-talk cancel filters, the transfer functions H7 and H8 may satisfy either of H7=H1, H8=0 or H7=1, H8=0 in the transfer functions of the filters described above.

The first virtual localization output is added to the front left channel signal FL with the adder 46 and then outputted as a signal $L_{OUT}$ for the front left speaker. In addition, the first virtual localization output is added to the front right channel signal FR with the adder 50 and then outputted as a signal $R_{OUT}$ for the front right speaker. Further, the second virtual localization output is added to the front center channel signal FC with the adder 48 and then outputted as a signal $C_{OUT}$ for the front center speaker.

In this embodiment, monophonic signals as the surround signals are supplied, which may cause reduction of the directivity. However, both the front left channel signal FL and the front right channel signal FR each is in stereophonic signal are respectively reproduced with the front left the speaker SPL and the front right speaker SPR thereby the directivity of the thus-produced sound image is maintained.

In addition, the front left channel signal and the front right channel signal are added respectively to the surround left channel signal and the surround right channel signal with the adders 52 and 54 in this embodiment. In this way, directivity reproduced through the surround signals can be maintained in the sound reproduced with the front speakers also when the surround signals are supplied as stereophonic signals.

A signal $SUB_{OUT}$ for woofers is produced by adding the front left channel signal FL, the front right channel signal FR and the center channel signal FC to the low frequency signal LFE with an adder 56.

In FIG. 6, k1 to k9 denote coefficient-processing means, the same reference numeral represents that the same coefficient is employed in the coefficient-processing.

Figure 10:
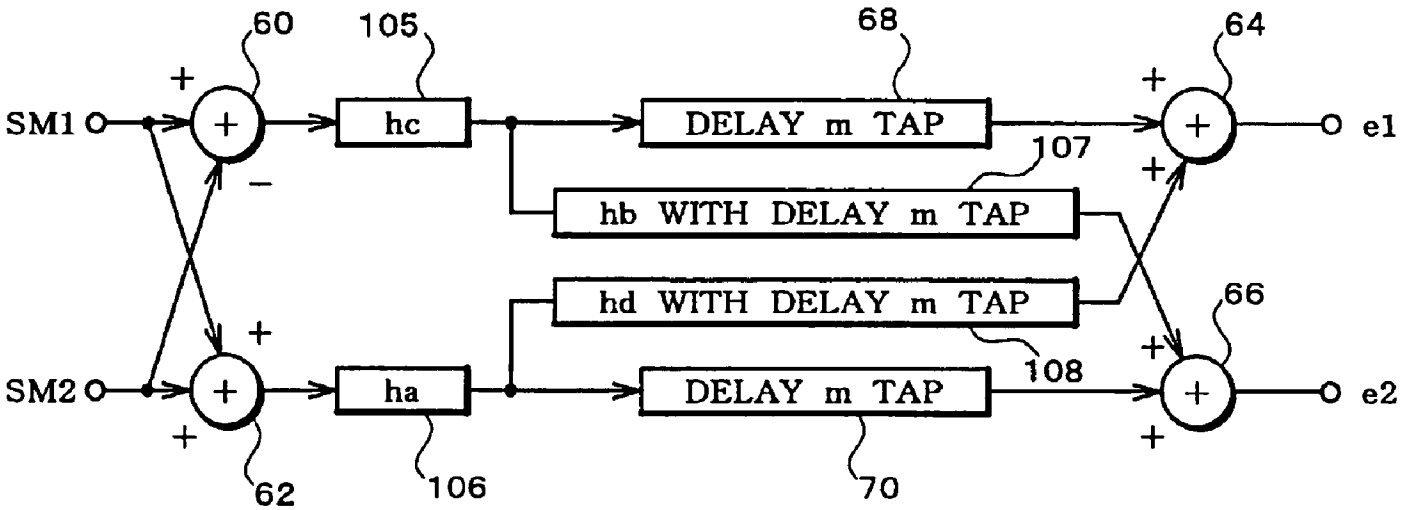
FIG. 10 is a signal-flow diagram illustrating virtual localization processing.

FIG. 10 shows another embodiment of the virtual localization processing. In this embodiment, the resulting signal subtracting the second monophonic signal SM2 from the first monophonic signal SM1 with a subtracter 60 is supplied to a fifth filter 105. Also, the resulting signal adding the first monophonic signal SM1 to the second monophonic signal SM2 with an adding means 62 is supplied to a sixth filter 106. The outputs of the fifth filter 105 and that of the sixth 106 are respectively supplied to a seventh filter 107 and an eighth filter 108.

The output of the eighth filter 108 and that of the fifth filter 105 are added with an adding means 64 so as to produce the first virtual localization output e1. Here, the output of the fifth filter 105 is subjected to a delay processing 68 having a delay in time equal to that of the eighth filter and then added with the adding means 64. Likewise, the output of the sixth filter 106 is subjected to a delay processing 70 having a delay in time equal to that of the seventh filter and then added to the output of the seventh filter 107 with the adding means 66, so as to produce the second virtual localization output e2.

Figure 11:
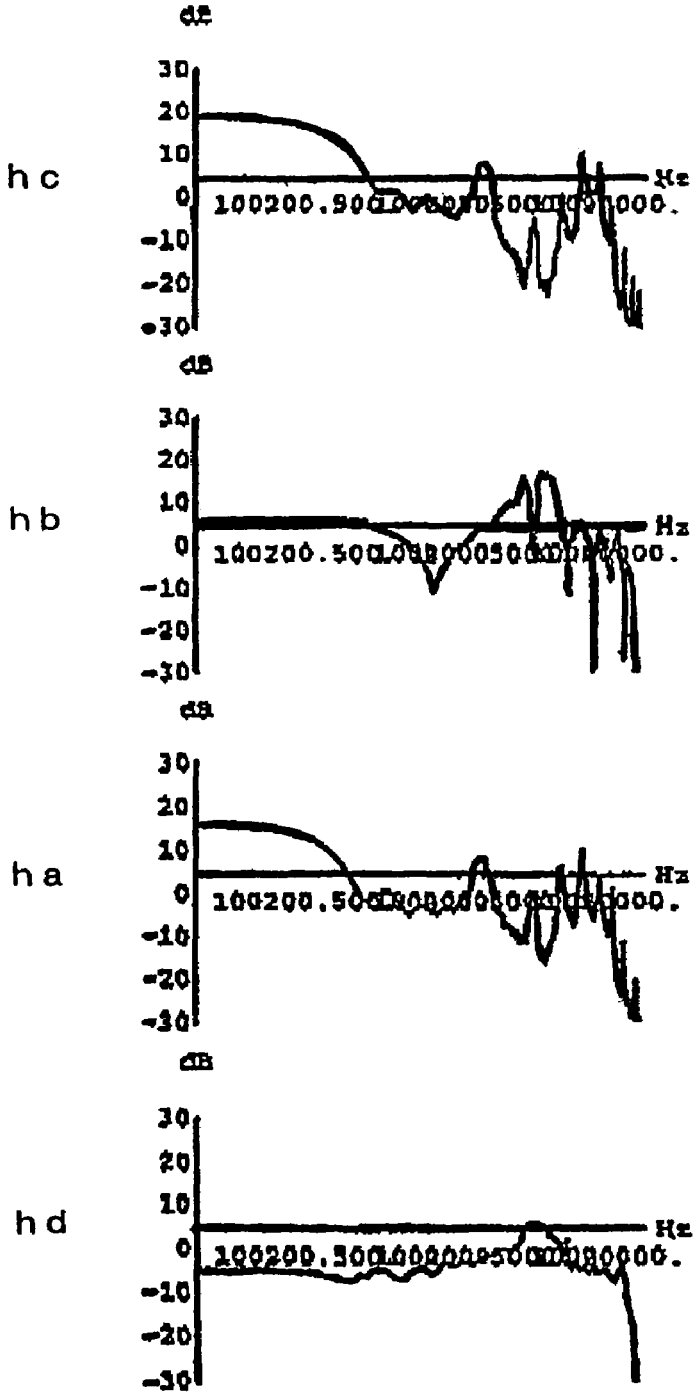
FIG. 11 shows graphs illustrating frequency characteristics of the filter shown in FIG. 10.

According to the structure shown in FIG. 10, transfer functions ha, hb, hc and hd of the sixth filter 106, of the seventh filter 107, of the fifth filter 105 and of the eighth filter 108 are respectively represented by the following equations:

FIG. 11 shows graphs illustrating frequency characteristics of the filters in the case of performing the virtual localizing process with a cross-talk cancel filter and defining the transfer functions as H7=H1 and H8=0. As apparent from the figure, not much gain is obtained by the seventh filter 107 (hb) and the eighth filter 108 (hd) especially in a low frequency region and their characteristics are in flat. In this way, the overall accuracy of the virtual localization processing can be maintained at a certain level as a whole while lowering the accuracy of both the seventh filter 107 and the eighth filter 108 in a low frequency region than that of both the fifth filter 105 and the sixth filter 106 in that area.

Figure 12:
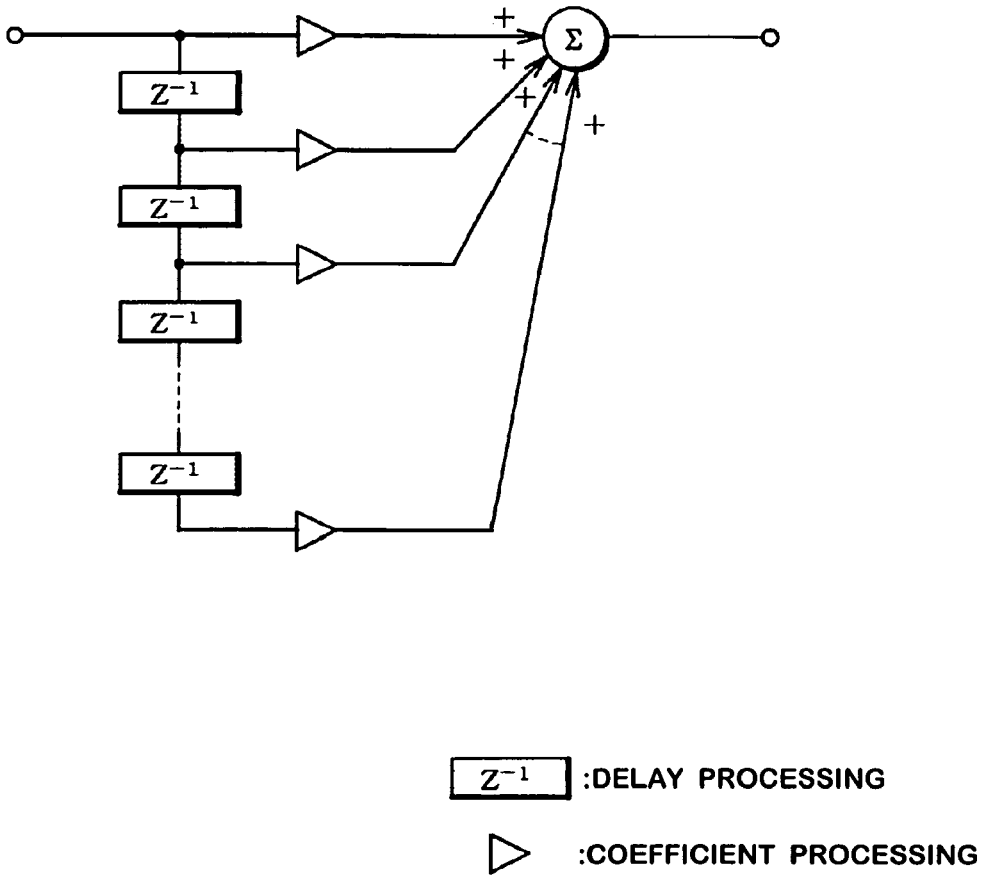
FIG. 12 is a diagram illustrating a basic structure of a finite impulse response filter (FIR filter).

For example, a virtual localization processing using a finite impulse response filter (FIR filter) shown in FIG. 12 for each of the filters will be described. In FIR filter, the number of delay processing is referred to as tap number. In the case of FIR filter, the larger tap number produces the higher accuracy in a low frequency region.

In contrast, the maximum tap number in the processing has a certain limit due to the processing capability of the DSP 22. According to this embodiment, the accuracy of a desired part is increased by allocating more taps in both the fifth filter 105 and the sixth filter 106 and less taps to both the seventh filter 107 and the eighth filter 108. It is, therefore, possible to increase the accuracy of the virtual localization processing under the limited processing capability.

In the embodiment described above, the accuracy of the filters not requiring a high accuracy in a low frequency region is made to relatively low, and that of the filters do requiring a high accuracy in the low frequency region is made to relatively high as a result of the use of the FIR filters along with varying the tap number.

Figure 13:
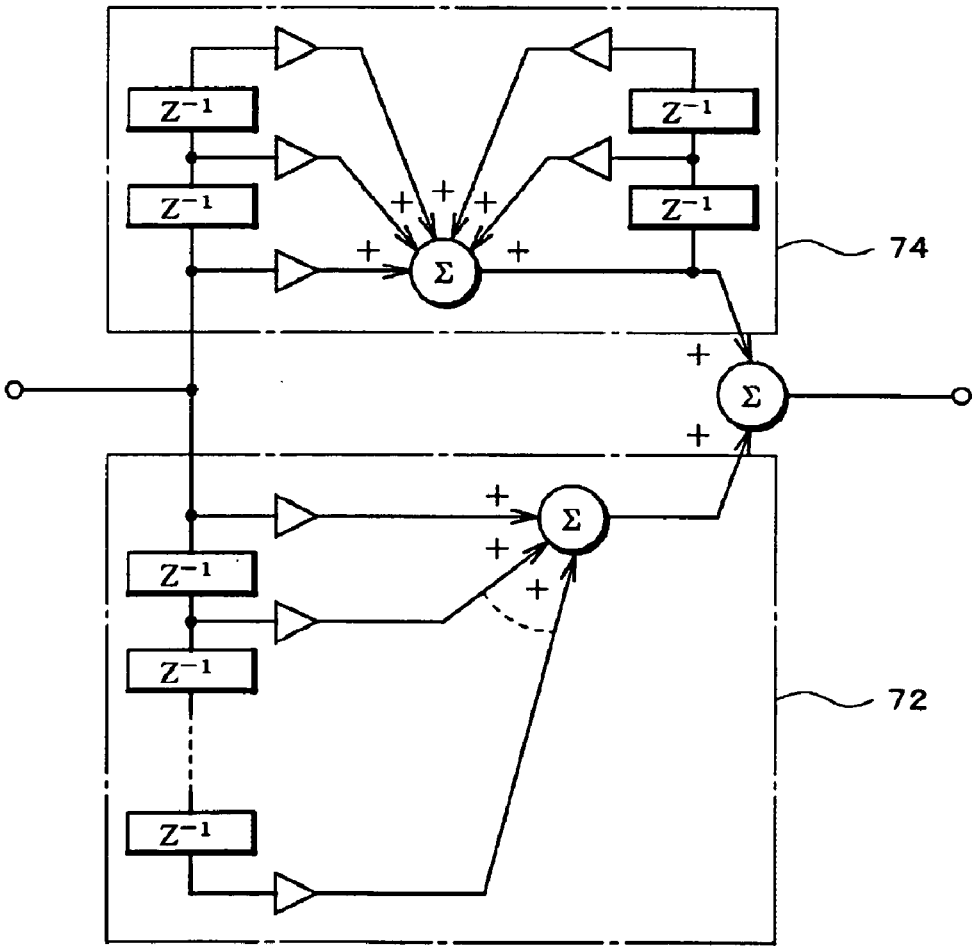
FIG. 13 is a diagram illustrating a FIR filter and a secondary infinite impulse response filter (IIR filter) connected each other in parallel manner.

Instead of the filters requiring a high accuracy in the low frequency region, a filter unit in which a FIR filter and an infinite impulse response filter (IIR filter) connected each other in parallel manner depicted in FIG. 13 can be used.

Figure 14:
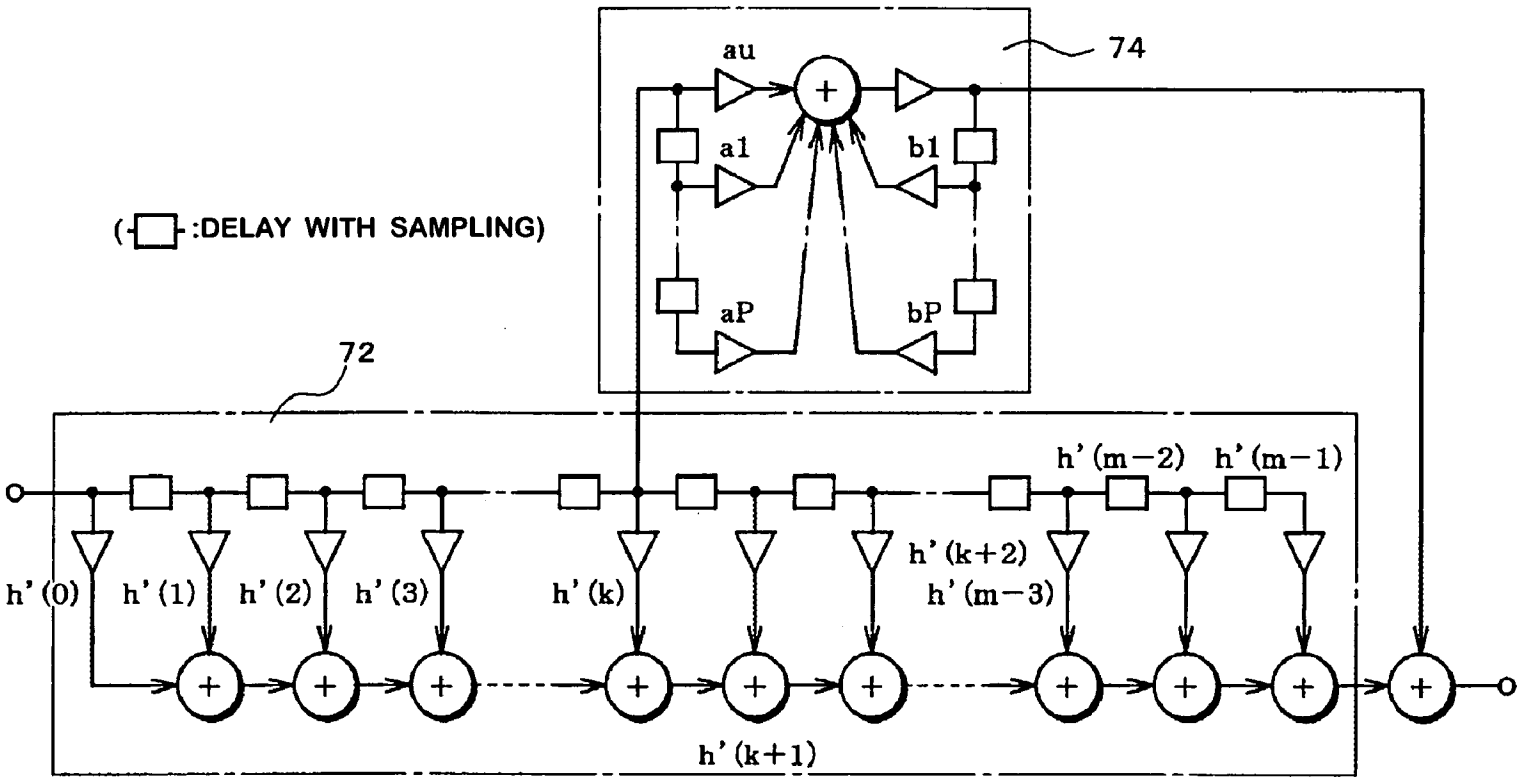
FIG. 14 is a diagram illustrating a FIR filter and an IIR filter connected to a tap provided at an intermediate position of the FIR filter.

Alternatively, another unit in which an IIR filter is connected to a tap located intermediate position of the FIR filter 72 depicted in FIG. 14 may also be used. The constitution shown in FIG. 14 facilitates the design of filters having desired characteristics.

Alternatively, the filters requiring a high accuracy in the low frequency region may be composed of a filter bank and the signals may pass through a FIR filter after performing down-sampling with the filter bank. The use of the filter bank allows the realization of a FIR filer having a substantially large tap number with a less tap number.

By the way, both the listeners 2 and 3 tend to look at the monitor 30 when monitor 30 is arranged at the center. In that case, the transfer functions H3 and H4 from the front center speaker SPC to both ears of the listeners are made to substantially equal. Under the circumstance, transfer functions h1, h2, h3 and h4 of the respective filters are represented by the following equations:

Since, h1=−h4 is satisfied, the virtual localization processing can be simplified as depicted in FIG. 16.

In FIG. 16, the resulting signal subtracting the second monophonic signal SM2 from the first monophonic signal SM1 with a subtracter 76 is supplied to a ninth filter 109. The output of the ninth filter 109 is turned out to the first virtual localization output e1.

The first monophonic signal SM1 is also supplied to a tenth filter 110. Moreover, the second monophonic signal SM2 is supplied to an eleventh filter 111. The outputs of both the tenth filter 110 and the eleventh filter 111 are added with an adder 78, and the output therefrom is turned out to the second virtual localization output e2.

As described above, virtual localization processing can be realized with less number of filters in this embodiment. For reference purpose, FIG. 17 shows graphs of frequency characteristics on the ninth filter, the tenth filter and the eleventh filter in the case of realizing the virtual localization processing by using these filters as cross-talk cancel filters.

Another virtual localization processing equivalent to that performed with the unit shown in FIG. 16 may be carried out with a unit depicted in FIG. 18. In the unit depicted in FIG. 18, the resulting signal subtracting a second monophonic signal SM2 from a first monophonic signal SM1 with a subtracter 84 is supplied to a twelfth filter 112. The resulting signal adding a first monophonic signal SM1 to a second monophonic signal SM2 with an adder 86 is supplied to a fourteenth filter 114. The output of the twelfth filter 112 is turned out to the first virtual localization output.

The output of the twelfth filter 112 is also supplied to a thirteenth filter 113. The output of the thirteenth filter 113 and that of the fourteenth filter 114 are added with an adder 90 and the resulting output is turned out to the second virtual localization output.

A transfer function hc of the twelfth filter 112 is equal to that of a transfer function h1 of the ninth filter 109 depicted in FIG. 16. Transfer functions ha and hb of both the thirteenth filter 113 and the fourteenth filter 114 are represented by the following equations:

FIG. 19 shows graphs illustrating frequency characteristics of the filters in the case of performing the virtual localizing process with cross-talk cancel filters under a condition of defining H7=H1 and H8=0. As apparent from the figure, not so much accuracy in a low frequency region is required for the thirteenth filter 113 and the fourteenth filter 114 in comparison with that for the twelfth filter 112. Accordingly, the overall accuracy can be kept higher without increasing the overall burden in the processing by designing the accuracy of the twelfth filter 112 in the low frequency region higher than that of the thirteenth filter 113 and the fourteenth filter 114 in such region.

FIG. 20 shows a signal-flow diagram of a filter unit in which FIR filters are used for the twelfth filter 112, the thirteenth filter 113 and the fourteenth filter 114, the tap number of the twelfth filter 112 and the thirteenth filter 113 being a total of 128 and of 32 respectively. The accuracy of the processing in a low frequency region is improved by increasing the tap number as a result of utilizing FIR filters in the unit depicted in FIG. 20. As described in the previous embodiment with reference to FIG. 10, however, the processing accuracy in the low frequency region may also be improved by connecting a FIR filter and an IIR filter in parallel manner as depicted in FIGS. 13 and 14. Furthermore, filter(s) requiring a high accuracy in a low frequency region may be composed of the filter bank.

In order to carry out an inverse filtering-processing, there is a case that some delays in time are preset to the twelfth filter 112, the thirteenth filter 113 and the fourteenth filter 114 on demand. In the embodiment depicted in FIG. 20, a delay processing circuit 92 having a delay in time equal to that defined in the thirteenth filter 113 is performed to the output of the twelfth filter 112. The output of the fourteenth filter 114 is subjected to a delay processing 94 in the same manner as the case of the processing 92.

In view of considering the delay processings, transfer functions ha, hb and hc of the twelfth filter 112, the thirteenth filter 113 and the fourteenth filter 114 are represented by the following equations when the virtual localization processing is realized by using the cross-talk cancel filters:

wherein δ(t-tl) represents a delay in time preset in the fourteenth filter 114 and the twelfth filter 112, and wherein δ(t-tm) represents a delay in time preset in the thirteenth filter 113.

Here, a review in the arrangement among listeners 2 and 3, and speakers is carried out. In FIG. 21, the front left speaker SPL and the front right speaker SPR are symmetrically arranged with respect to the front center speaker SPC. An angle θ1 made among the front left speaker SPL, the listener and the front center speaker SPC, and another angle θ2 made among the front center speaker SPC, the listener and the front right speaker SPR are almost equal to each other for the listener who look at the front center speaker SPC when a distance X between the speakers and the listeners is far bigger than a width WS between the front left speaker SPL and the front right speaker SPR. That is, both the angles θ1 and θ2 are represented by θas depicted in FIG. 21. In consideration of these conditions, only the differences between the front left speaker SPL and the front right speaker SPR are both a sound attenuation kLR in distance induced by the distance from the listener thereto and a delay δ(t-tLR) from a view point of the front left speaker SPL. As a consequence, transfer functions H1 to H6 shown in FIG. 21 may be summarized as the followings:

wherein the transfer functions of the respective filters 114, 113 and 112 are simplified as the following equations:

$$hc = \delta(t-t1)*H(-\theta)\text{deg}/((H(-\theta)\text{deg} - H(+\theta)\text{deg})*(1-kLR*\delta(t-tLR))$$
$$= 1/(1-kLR*\delta(t-tLR))*hc'$$
$$hb = -\delta(t-tm)*((H(-\theta)\text{deg} - H(+\theta)\text{deg}))*(1-kLR*\delta(t-tLR))/(kLC*\delta(t-tLC)H0\text{deg})$$
$$= hb'*(1+kLR*\delta(t-tLR))*(1/kLC)/\delta(t-tL)$$
$$ha = \delta(t-t1)*H(-\theta)\text{deg}/(kLC*\delta(t-tLC)*H0\text{deg})$$
$$= ha'*(1/kLC)/\delta(t-tLC).$$

In other words, the twelfth filter 112 may be formed of; a filter 112*a* having a transfer function hc', a delay processing circuit 112*c* which provides the output of the filter 112*a* with a delay in an amount of nLR samples, a multiply circuit 112*d* multiplying the resulting signal by kLR times and an adder 112*e* adding the output of the filter 112*a* to the output of the multiply circuit 112*d*, as depicted in FIG. 22. The thirteenth filter 113 may be formed of; a filter 113*a* having a transfer function of hb', a multiply circuit 113*b* multiplying the resulting signal by 1/kLC times, a delay processing circuit 113*c* which provides the output of the filter 112*a* with a delay in an amount of nLR samples, a multiply circuit 113*d* multiplying the resulting signal by kLR times and an adder 113*e* adding the output of the filter 113*d* to the output of the multiply circuit 113*b*. Moreover, the fourteenth filter 114 may be composed of the fourteenth filter 114*a* having a transfer function of ha' and a multiply circuit 114*b* multiplying the output signal by 1/kLC times.

Since an inverse filter of the delay 1/δ (t-tLC) common to both the transfer functions ha and hb for generating the second virtual localization output e2 represents a phenomenon in which the phase in time is advanced for tLC, such filter can not be realized. The filter is realized by making the phase in time of the first virtual localization output e2 in delay for tLC relative to the other output. In other words, a delay processing circuit 96 having a delay in time for m+nLC is used instead of the delay processing circuit 92 having a delay in time for m.

FIG. 23 comparatively shows a graph illustrating transfer functions hc, hb, ha of the filters 112, 113 and 114 depicted in FIG. 20, and a graph illustrating transfer functions hc', hb' and ha' of the filters 112*a*, 113*a* and 114*a* shown in FIG. 22 in the case of performing the virtual localizing process with cross-talk cancel filters under a condition of defining H7=H1 and H8=0. As apparent from the graphs, duration of impulse responses for the filters depicted in FIG. 22 is shorter than that of the filters shown in FIG. 20 among all the filters (especially for the filter 112*a*), so that it is appreciated that the tap number of the FIR filter can be decreased.

In the structure depicted in FIG. 22, transfer functions ha', hb' and hc' are defined by using the angles (angles θ depicted in FIG. 21) made among the speakers and the listener as the sole parameter as apparent from the equations for defining transfer functions ha, hb and hc shown in above. In this way, sound attenuation in distance and delay both varying in accordance with both a distance between listeners 2, 3 and the speakers (distance X depicted in FIG. 21) and another distance (width WS depicted in FIG. 21) between the front left speaker SPL and the front right speaker SPR can independently be controlled.

It is hard for the conventional technique to prepare and store in advance optimum parameters for all the arrangements in the memory having a limited capability because of its incapability for handling the influences created by the angles θ, the distance X and the width WS under independent manner. In the structure depicted in FIG. 22, however, since the angles θ, the distance X and the width WS can be independently handled, the following procedure can be employed. The procedure includes storing in advance the parameters of the transfer functions ha', hb' and hc' which depend upon the angle θ, and the values of multiple circuits 112*d*, 113*b*, 113*d* and 114*b* and those of the delay processing circuits 112*c*, 113*c* and 96 which depend upon the distance X and the width WS in the memory 26 as a table, and selecting and combining them so as to obtain optimum characteristics.

In this way, optimum characteristics and/or parameters are selected from the table in response to an input of angles θ, distance X and width WS by the listener when he/she sets up the system, so that surround-effect suitable for speaker arrangement may be obtained. In this case, input of the angles and the distance may either be carried out by an input portion of the device or a remote controller.

Optimum characteristics for potential arrangements of device(s) other than that depicted in FIG. 22 can further be set by previously storing parameters and/or values in the memory if enough capability left in the memory 26.

With a feedback delay processing loop depicted in FIG. 22 including the delay processing circuit 112*c*, the multiply circuit 112*d* and the adder 112*e*, very keen peaks are periodically observed in a high frequency region in a graph depicted in FIG. 25A illustrating frequency characteristics. In view of this, the feedback delay-processing loop may be formed with a FIR filter as shown in FIG. 24. In this way, discordant sounds can be eliminated because of elimination of the keen peaks. Similar advantages can be expected if a low-pass filter is provided instead of the FIR filter.

As described earlier, the virtual localization processing means 12 can be simplified as depicted FIG. 16 when the listeners 2 and 3 look at the front center speaker SPC under an assumption that the transfer function H3 is equal to the transfer function H4. FIG. 26 is another example of the virtual localization processing means 12 further simplified. In this embodiment, virtual localization processings that substantially equalize responses of both ears of the listeners 2 and 3, that is, the processings wherein conditions equivalent to the followings are achieved; both the virtual speakers XL2 and XR2 are respectively localized at the left and the right to the listener 2 in symmetrical manner, and both the virtual speakers XL3 and XR3 are respectively localized at the left and the right to the listener 3 in symmetrical manner.

FIG. 27 is a schematic view illustrating a relationship in positions among the listener 2 and the virtual speakers XL2, XR2 from a viewpoint of the listener 2. The transfer functions H7 and H8 depicted in FIG. 27 are respectively represented by the following equations as a result of using the transfer functions H1, H2, H5 and H6 depicted in FIG. 15:

Transfer functions H3 and H4 have the following relationship if the listener look at the front center speaker SPC similar to the case of FIG. 15:

H3=H4.

The following results come up when the relationship is substituted in the equations expressing h1, h2, h3 and h4 described earlier:

In other words, the virtual localization processing means 12 depicted in FIG. 6 can be simplified as one single filter shown in FIG. 26. In FIG. 26, coefficient processings 150 and 152 respectively multiply a first monophonic signal eL and a second monophonic signal eR by ½ times, wherein both the monophonic signals have already been processed under reduce correlation. The output from the processing 152 is supplied to a fifteenth filter 115. The output of the fifteenth filter 115 is turned out to a second virtual localization output e2.

A subtracter 154 subtracts the output of the coefficient processing 152 from that of the coefficient processing 150 and the resultant signal is supplied to a delay processing circuit 156. The output of the delay processing circuit 156 is turned out to the first virtual localization output e1. The delay in time at the delay processing circuit 156 is set so as to be substantially equal to that of the fifteenth filter 115.

Another advantage in which the listeners feel like speakers are symmetrically localized at the right and the left therefrom even the speakers actually located unsymmetrical position, can be obtained by performing the virtual localization processings that make responses of both ears of the listeners 2 and 3 substantially equal with each other. By applying the reduce correlation described earlier to the series of processings, surround channel signals by which sound field just as extending around the listeners without deviation can be reproduced even with a very simple unit.

The virtual localization processings are performed solely on the surround signals in the embodiments described above, the virtual localization processings (processings for extending a frontal sound field) may additionally be carried out on a front left channel signal FL and a front right channel signal FR as well. FIG. 28 shows a signal-flow diagram illustrating an example of the virtual localization processings.

As shown in FIG. 28, a front left signal FL and a front right signal FR are mixed with an adder 160 so as to be monauralized. The output of the adder 160 is further added to a center channel signal FC with an adder 162.

Delay processing means 164L, 164C and 164R (collectively referred to as a delay processing means 164) respectively provided to the front left signal FL, the output of the adder 162 and the front right signal FR perform delay processing. The delay processing means are provided for compensating the delay which arise through a high-pass filter (HPF) 32, the reduce correlation means 34 and the virtual localization processing means 12 described later, and the delay processing means performs a delay processing which provides a delay in time equal to the total delay in time of these processing means.

In contrast, a differential signal between the front left signal FL and the front right signal FR is obtained with a subtracter 166. The output of the subtracter 166 is added to a surround channel signal S with an adder 168.

The output of the adder 168 is filtered with a high-pass filter (HPF) 32, then the resulting signal is branched to a first monophonic signal and a second monophonic signal and supplied to the reduce correlation means 34 for reduce correlation processing in the same manner as FIG. 6. The first monophonic signal and the second monophonic signal thus processed under the reduce correlation are supplied to the processing means 12.

The first virtual localization output of the processing means 12 is added to the output of a delay processing means 164L with an adder 170 and the resulting signal is then outputted as a signal $L_{OUT}$ for the front left speaker. The first virtual localization output is also added to the output of an adder 164R with an adder 174 and the resulting signal is then outputted as a signal $R_{OUT}$ for the front right speaker. In addition, the second virtual localization output thereof is added to the output of a delay processing means 164C with an adder 172 and the resulting signal is then outputted as a signal $C_{OUT}$.

The arrangement among the listeners, and the speakers in this embodiment is similar to that depicted in FIG. 5. FIG. 29 is a schematic view briefly illustrating a relationship in positions among listener 2 and the speakers from a viewpoint of the listener 2.

As depicted in FIG. 29, the front left signal FL and the front right signal FR are reproduced respectively with the front left speaker SPL and the front right speaker SPR, and a signal in monaural as a result of mixing both the front left signal FL and the front right signal FR is reproduced with the front center speaker SPC.

In contrast, another differential signal between the front left signal FL and the front right signal FR is processed with the processing means 12 together with the surround channel signal S, and the resulting signal is reproduced with the virtual surround left sound source XL2 and the virtual surround right sound source XR2.

Accordingly, both the front left signal and the front right signal can be reproduced so as to widen its frontal width than that reproduced with the speakers actually arranged by supplying the differential signal between the front left signal FL and the front right signal FR to the virtual localization processing means 12 and processed thereby. Consequently, a sufficient frontal width can be maintained even when the width between the front speakers is insufficient. Simplification in processing and that in structure can be realized because these processes are carried out with the processing means 12 for performing localization processing to the surround channel signals.

Exactly the same principle described above can be applied to the listener 3. In this way, both the front left signal and the front right signal can be reproduced so as to widen its frontal width without causing reverse of stereophonic sound fields to a plurality of listeners sitting next to each other under side-by-side basis.

Although, the virtual localization processing means 12 is used for performing localization processing in this embodiment, the localization processing is not limited to use the processing means. The localization processing may also be performed with the processings depicted in FIGS. 10, 16, 18, 20, 22 and 26, for example.

FIG. 30 is a signal-flow diagram illustrating virtual localization processing in another embodiment of the present invention. In this embodiment, both a filter 200 (a compensation filter means) for compensating difference in characteristics among the speakers SPL, SPR, and SPC when each of the speaker has unique characteristics and attenuation processing means 202, 204 (amplitude adjusting means for compensation) are provided. With the filter 200, the differences in frequency characteristics among the speakers SPC, SPL and SPR are compensated and compensation of the differences in gain among the speakers SPC, SPL and SPR can be performed. In this way, similar sound fields reproduced with the speakers having the same characteristics can be obtained even if speakers having different characteristics are used therefor.

The filtering, attenuation and related processing thereto are performed with the DSP in the embodiments described above, these processings may also be realized with an analog circuit(s).

Considering the overflow in calculation, it is preferred to carry out coefficient processing (scaling) in the case of using a DSP performing calculation under fixed point digital signal processing for the units in the embodiments described above.

Various functions illustrated in the signal flows are performed with the DSP 22 in the embodiments described above, however, at least part of which may be performed with a hardware circuit(s).

The processing method according to the present invention is characterized in that, arranging positions of the front left speaker and the front right speaker and that of the first listener and the second listener so as to be symmetrical to one another with respect to a central axis extending between the front center speaker and a point located at an intermediate position between the first listener and the second listener; supplying a resulting signal for creating virtual sound sources to the front left speaker, the front center speaker and the front right speaker so as to output monophonic sounds from the surround left sound source and the surround right sound source, the resulting signals being generated by performing virtual localization processing to a given surround signal; and creating the surround left sound source and the surround right sound source to both the first listener and the second listener as a result of supplying the same signal for creating the virtual sound sources to the front left speaker and the front right speaker.

The first listener and the second listener are positioned symmetrically with respect to the front left speaker, the front center speaker and the front right speaker, so that the surround left sound source and the surround right sound source can be created to both the first listener and the second listener as a result of supplying the same signal for creating the virtual sound sources to the front left speaker and the front right speaker. In this case, sound fields virtually reproduced with the surround left sound source and the surround right sound source are in reverse. In the present invention, however, no reversal of the sound fields to the first listener and the second listener is observed as a result of outputting the sound fields as monophonic sounds. In this way, an advantage of surround-effect may be obtained.

The surround signal processing system and the surround signal processing device according to the present invention is characterized in that, the surround channel signals are supplied to a virtual localization processing means as a first monophonic signal and a second monophonic signal; wherein a first virtual localization output of the virtual localization processing means is supplied to the front left speaker and the front right speaker, and wherein a second virtual localization output of the virtual localization processing means is supplied to the front center speaker.

As a consequence, no reversal of stereophonic sound fields for two listeners is observed while creating the surround left sound source and the surround right sound source to the two listeners sitting next to each other under side-by-side basis. In this way, an advantage of surround-effect may be provided to the listeners.

The surround signal processing system according to the present invention is characterized in that, a surround left channel signal is supplied to the front left speaker and a surround right channel signal is supplied to the front right speaker. Also, the surround signal processing device according to claim 10, the surround left channel signal is further added to the signal outputted as the signal for the front left speaker, and the surround right channel signal is further added to the signal outputted as the signal for front right speaker.

Consequently, directivity once lost by monauralization of the surround left channel signal and the surround right channel signal can be reproduced with the front left speaker and the front right speaker, so that high-quality surround audio sounds can be reproduced.

The surround signal processing system according to the present invention is characterized in that, the system comprise a display device for displaying images thereon, and at least the front speaker is built in the display device.

In this way, surround-effect can be provided to the two-listener sitting next to each other under side-by-side basis while displaying images thereto.

The surround signal processing device according to the present invention is characterized in that, resulting signals, one of the which is generated by performing a subtract processing on the front left channel signal and the front right channel signal and the other is generated by adding the surround channel signals, are supplied to a virtual localization processing means as a first monophonic signal and a second monophonic signal; and signals at least containing a signal capable of being obtained by providing a delay in time substantially equal to that of the virtual localization processing means on the front left channel signal and a first virtual localization output of the virtual localization processing means, are output as a signal for the front left speaker; and signals at least containing a signal capable of being obtained by providing a delay in time substantially equal to that of the virtual localization processing means on the front right channel signal and the first virtual localization output of the virtual localization processing means, are output as a signal for the front right speaker; and signals at least containing a signal capable of being obtained by providing a delay in time substantially equal to that of the virtual localization processing means on a resulting signal generated by adding the front left channel signal and the front right channel signal and a second virtual localization output of the virtual localization processing means, are output as a signal for the front center speaker; are output as a signal for the front center speaker.

As a consequence, both the front left signal and the front right signal can be reproduced so as to widen its frontal width than that reproduced with the speakers actually arranged without causing reverse of stereophonic sound fields to the two listeners sitting next to each other under side-by-side basis, so that a sufficient frontal width can be maintained even when the width between the front speakers is insufficient. Simplification in processing and that in structure can be realized because these processes are carried out under the virtual localization processing for performing virtual localization to the surround channel signals.

The surround signal processing device according to the present invention is characterized in that, the first monophonic signal and the second monophonic signal are supplied to the virtual localization processing means after performing a reduce correlation in which correlation between the first monophonic signal and the second monophonic signal is reduced. In this way, surround sound field just as extending around the listeners can be provided without causing deviation of the monophonic sound field reproduced by the virtual surround sound sources at unnatural positions nor undesired localization of the sound image in the head of the listener.

The surround signal processing device according to the present invention is characterized in that, the virtual localization processing means comprises: a first filter means, performing a processing upon receipt of the first monophonic signal; a second filter means, performing a processing upon receipt of the first monophonic signal; a third filter means, performing a processing upon receipt of the second monophonic signal; a fourth filter means, performing a processing upon receipt of the second monophonic signal; a first adding means, making a resulting data generated as a result of adding outputs of the first filer means and that of the fourth filter means as a first virtual localization output; and a second adding means, making a resulting data generated as a result of adding outputs of the second filer means and that of the third filter means as a second virtual localization output.

As a consequence, the surround left sound source and the surround right sound source can be given to the two listeners sitting to each other under side-by-side basis without causing reversal of stereophonic sound fields, which provides the two listeners with sufficient surround effect.

The surround signal processing device according to the present invention is characterized in that, the virtual localization processing means comprises: a fifth filter means, performing a processing upon receipt of the first monophonic signal; a sixth filter means, performing a processing upon receipt of a second monophonic signal; a seventh filter means, performing a processing upon receipt of an output of the fifth filter means; a eighth filter means, performing a processing upon receipt of an output of the sixth filter means; a first adding means, making a resulting data generated as a result of adding an output of the fifth filer means and that of the eighth filter means as a first virtual localization output; and a second adding means, making a resulting data generated as a result of adding an output of the sixth filer means and that of the seventh filter means as a second virtual localization output.

The seventh filter means and the eighth filter means respectively performs the processing upon receipt of the output of the fifth filter means and that of the sixth filter means. In this way, load in the processing for both the seventh filter means and the eighth filter means can be decreased.

The surround signal processing device according to the present invention is characterized in that, the virtual localization processing means comprises a delay processing means having a delay in time equal to that defined in the seventh filter means and the eighth filter means respectively in the fifth filter means and the sixth filter means. Consequently the delay in time can be compensated even when the delay is set to both the seventh filter means and the eighth filter means.

The surround signal processing device according to the present invention is characterized in that, the virtual localization processing means comprises: a ninth filter means, making a resulting data generated as a result of performing a subtract processing between the first monophonic signal and the second monophonic signal as the first virtual localization output; a tenth filter means, performing a processing upon receipt of the first monophonic signal; an eleventh filter means, performing a processing upon receipt of the second monophonic signal; and an adding means, making a resulting data generated as a result of adding an output of the tenth filer means and that of the eleventh filter means as the second virtual localization output.

The surround-effect can be obtained with three filter means when a transfer functions from the front center speaker to the left ear of the listener and that from the front center speaker to the right ear of the listener is substantially equal to each other (e.g., when the listeners look at the front center speakers).

The surround signal processing device according to the present invention is characterized in that, the virtual localization processing means comprises: a twelfth filter means, making a resulting data generated as a result of performing a subtract processing between the first monophonic signal and the second monophonic signal as the first virtual localization output; a thirteenth filter means, performing a processing upon receipt of an output of the twelfth filter means; a fourteenth filter, performing a processing upon receipt of a resulting data generated as a result of performing an adding processing between the first monophonic signal and the second monophonic signal; and an adding means, making a resulting data generated as a result of adding an output of the thirteenth filer means and that of the fourteenth filter means as the second virtual localization output.

In this way, load in the processing for the thirteenth filter means can be decreased because the thirteenth filtering means performs the processing upon receipt of the output of the twelfth filter means.

The surround signal processing device according to the present invention is characterized in that, the virtual localization processing means comprises a delay processing means having a delay in time equal to that defined in the thirteenth filter means respectively in the twelfth filter means and the fourteenth filter means. Consequently the delay in time can be compensated even when the delay is set to the thirteenth filter means.

The surround signal processing device according to the present invention is characterized in that, accuracy of the twelfth filter means in a low frequency region is increased to a level than that of the thirteenth filter means and the fourteenth filter means in the low frequency region. It is, therefore, possible to increase the overall accuracy of the virtual localization processing means under the limited processing capability by intensively allocating the processing capability on the twelfth filter means requiring a high accuracy in a low frequency region.

The surround signal processing device according to the present invention is characterized in that, the twelfth filter means includes a processing means performing a filtering processing and a delay attenuation feedback loop connected to an output of the filtering processing; and the thirteenth filter means comprises a processing means performing a filtering processing and a means for adding a resulting output which performs both attenuation and delay processing to an output of the filter means to the output of the filter means; and the fourteenth filter includes a processing means performing a filtering processing and a means for attenuating an output of the processing means; and an output of the twelfth filter means is made to the first virtual localization output after performing a delay processing; and outputs of the thirteenth filter means and that of the fourteenth filter means are made to the second virtual localization output. In this way, load in the means for performing each of the filtering processings can be decreased. In addition, variations in parameters varying based on angles among the listeners and the speakers, that in distance among the listeners and the speakers, and that in the amount of sound attenuation and delay cause by the distance among the speakers can be independently controlled.

The surround signal processing device according to the present invention is characterized in that, the device further comprises: a fifteenth filter means, performing a processing upon receipt of the second monophonic signal and making a resulting signal of the processing to the second virtual localization output; and a delay processing means having a delay in time substantially equal to that defined in the fifteenth filter means and making a resulting data generated as a result of performing a subtract processing between the first monophonic signal and the second monophonic signal as the first virtual localization output.

Consequently, surround sound field just as extending around the listeners can easily be reproduced without causing deviation even when a very simple unit is employed.

The surround signal processing device according to the present invention is characterized in that, parameters vary based on arrangements among the front left speaker, the front center speaker, the front right speaker and the listener are previously stored in a storing means; and an optimum parameter is selected in accordance with an arrangement being input. In this way, an optimum surround-effect in accordance with the arrangement can be obtained.

The surround signal processing device according to the present invention is characterized in that, the device further comprising: one of an amplitude adjusting means for compensation and a compensation filter means, each for compensating differences in characteristics between the front right speaker and front left speaker. Consequently, a surround-effect with very high quality can be achieved even when each of the front left speaker, the front center speaker and the front right speaker has unique characteristics.

While the embodiments of the present invention, as disclosed herein, constitute preferred forms, it is to be understood that each term was used as illustrative and not restrictive, and can be changed within the scope of the claims without departing from the scope and spirit of the invention.

What is claimed is:

1. A processing method of a front left channel signal, a front center channel signal, a front right channel signal, and a pair of monophonic surround signals for virtually creating a surround left sound source and a surround right sound source to a first listener and a second listener through a front left speaker, a front center speaker, and a front right speaker, comprising the steps of:

placing the front left speaker and the front center speaker respectively to front left side and front right side of the first listener;

placing the front center speaker and the front right speaker respectively to a front left side and a front right side of the second listener;

arranging the front left speaker and the front right speaker symmetrically with respect to a central axis extending from the front center speaker and to the middle point between the first listener and the second listener, while arranging the first listener and the second listener symmetrically with respect to the central axis;

performing virtual localization processing to the pair of monophonic surround signals to produce a first and a second virtual localization output for creating a surround left source and surround right source;

supplying the front left channel signal, the front center channel signal and the front right channel signal respectively to the front left speaker, the front center speaker and the front right speaker; and supplying the first virtual localization output to the front left speaker and supplying the first virtual localization output to the front right speaker and supplying the second virtual localization output to the center so as to create the surround left sound source and the surround right sound source to both the first listener and the second listener.

2. In a surround signal processing system for virtually creating a surround left sound source and a surround right sound source through a front left speaker, a front center speaker and a front right speaker upon receipt of a front left channel signal, a front center channel signal, a front right channel signal, a surround left channel signal and a surround right channel signal;

wherein resulting signals generated by mixing the surround left channel signal and the surround right channel signal are supplied to a virtual localization processing means as a first monophonic signal and a second monophonic signal while the front left channel signal, the front center channel signal and the front right channel are supplied respectively to the front left speaker, the front center speaker and the front right speaker;

wherein a first virtual localization output of the virtual localization processing means is supplied to the front left speaker and the front right speaker; and wherein a second virtual localization output of the virtual localization processing means is supplied to the front center speaker.

3. In a surround signal processing system for virtually creating a surround left sound source and a surround right sound source through a front left speaker, a front center speaker and a front right speaker upon receipt of a front left channel signal, a front center channel signal, a front right channel signal, and a surround left channel signal and a surround right channel signal;

wherein the front left channel signal, the front center channel signal and the front right channel signal are supplied respectively to the front left speaker, the front center speaker and the front right speaker;

wherein resulting signals generated by mixing the surround left channel signal and the surround right channel signal are supplied to a virtual localization processing as a first monophonic signal and a second monophonic signal;

wherein a first virtual localization output of the virtual localization processing means is supplied to the front left speaker and the front right speaker; and wherein a second virtual localization output of the virtual localization processing means is supplied to the front center speaker.

4. The surround signal processing system according to claim 2, wherein the surround left channel signal is supplied to the front left speaker; and wherein the surround right channel signal is supplied to the front right speaker.

5. In a surround signal processing system for virtually creating a surround left sound source and a surround right sound source through a front left speaker, a front center speaker and a front right speaker upon receipt of a front left channel signal, a front center channel signal, a front right channel signal, and surround channel signals;

wherein the front left channel signal, the front center channel signal and the front right channel signal are supplied respectively to the front left speaker, the front center speaker and the front right speaker;

wherein the surround channel signals are supplied to a virtual localization processing means as a first monophonic signal and a second monophonic signal;

wherein a first virtual localization output of the virtual localization processing means is supplied to the front left speaker and the front right speaker; and wherein a second virtual localization output of the virtual localization processing means is supplied to the front center speaker.

6. The surround signal processing system according to claim 2, the system comprises a display device for displaying images thereon, and wherein at least the front speaker is built in the display device.

7. In a surround signal processing device for virtually creating a surround left sound source and a surround right sound source through a front left speaker, a front center speaker and a front right speaker upon receipt of a front left channel signal, a front center channel signal, a front right channel signal, a surround left channel signal and a surround right channel signal;

wherein resulting signals generated by mixing the surround left channel signal and the surround right channel signal are supplied to a virtual localization processing means as a first monophonic signal and a second monophonic signal;

wherein a signal at least containing the front left channel signal and a first virtual localization output of the virtual localization processing means is output as a signal for the front left speaker;

wherein a signal at least containing the front right channel signal and the first virtual localization output of the virtual localization processing means is output as a signal for the front right speaker; and wherein a signal at least containing the front center channel signal and a second virtual localization output of the virtual localization processing means is output as a signal for the front center speaker.

8. In a surround signal processing device for virtually creating a surround left sound source and a surround right sound source through a front left speaker, a front center speaker and a front right speaker upon receipt of a front left channel signal, a front center channel signal, a front right channel signal, and a surround left channel signal and a surround right channel signal;

wherein resulting signals generated by mixing the surround left channel signal and the surround right channel signal are supplied to a virtual localization processing means as a first monophonic signal and a second monophonic signal;

wherein a signal at least containing the front left channel signal and a first virtual localization output of the virtual localization processing means is output as a signal for the front left speaker;

wherein another signal at least containing the front right channel signal and the first virtual localization output of the virtual localization processing means is output as a signal for the front right speaker; and wherein a signal at least containing the front center channel signal and a second virtual localization output of the virtual localization processing means is output as a signal for the front center speaker.

9. In a surround signal processing device for virtually creating a surround left sound source and a surround right sound source through a front left speaker, a front center speaker and a front right speaker upon receipt of at least a front left channel signal, a front right channel signal and surround channel signals;

wherein resulting signals, one of the which is generated by performing a subtract processing on the front left channel signal and the front right channel signal and the other is generated by adding the surround channel signals, are supplied to a virtual localization processing means as a first monophonic signal and a second monophonic signal;

wherein signals at least containing a signal capable of being obtained by providing a delay in time substantially equal to that of the virtual localization processing means on the front left channel signal and a first virtual localization output of the virtual localization processing means, are output as a signal for the front left speaker;

wherein signals at least containing a signal capable of being obtained by providing a delay in time substantially equal to that of the virtual localization processing means on the front right channel signal and the first virtual localization output of the virtual localization processing means, are output as a signal for the front right speaker; and wherein signals at least containing a signal capable of being obtained by providing a delay in time substantially equal to that of the virtual localization processing means on a resulting signal generated by adding the front left channel signal and the front right channel signal and a second virtual localization output of the virtual localization processing means, are output as a signal for the front center speaker.

10. The surround signal processing device according to claim 7, wherein the surround left channel signal is further added to the signal outputted as the signal for the front left speaker, and wherein the surround right channel signal is further added to the signal outputted as the signal for front right speaker.

11. In a surround signal processing device for virtually creating a surround left sound source and a surround right sound source through a front left speaker, a front center speaker and a front right speaker upon receipt of a front left channel signal, a front center channel signal, a front right channel signal, and surround channel signals;

wherein the surround channel signals are supplied to a virtual localization processing means as a first monophonic signal and a second monophonic signal;

wherein a signal at least containing the front left channel signal and a first virtual localization output of the virtual localization processing means is output as a signal for the front left speaker;

wherein another signal at least containing the front right channel signal and the first virtual localization output of the virtual localization processing means is output as a signal for the front right speaker; and wherein a signal at least containing the front center channel signal and a second virtual localization output of the virtual localization processing means is output as a signal for the front center speaker.

12. In a surround signal processing device for virtually creating a surround left sound source and a surround right sound source through a front left speaker, a front center speaker and a front right speaker upon receipt of at least a front left channel signal, a front right channel signal and surround left and surround right channel signals;

wherein resulting signals, one of the which is generated by performing a subtract processing on the front left channel signal and the front right channel signal and the other is generated by adding the surround left channel signal and the surround right channel signal, are supplied to a virtual localization processing means as a first monophonic signal and a second monophonic signal;

wherein signals at least containing a signal capable of being obtained by providing a delay in time substantially equal to that of the virtual localization processing means on the front left channel signal and a first virtual localization output of the virtual localization processing means, are output as a signal for the front left speaker;

wherein signals at least containing a signal capable of being obtained by providing a delay in time substantially equal to that of the virtual localization processing means on the front right channel signal and the first virtual localization output of the virtual localization processing means, are output as a signal for the front right speaker; and wherein signals at least containing a signal capable of being obtained by providing a delay in time substantially equal to that of the virtual localization processing means on a resulting signal generated by adding the front left channel signal and the front right channel signal and a second virtual localization output of the virtual localization processing means, are output as a signal for the front center speaker.

13. The surround signal processing device according to claim 7, wherein the first monophonic signal and the second monophonic signal are supplied to the virtual localization processing means after performing a reduce correlation in which correlation between the first monophonic signal and the second monophonic signal is reduced.

14. The surround signal-processing device according to claim 7, wherein the virtual localization processing means comprises:

a first filter means, performing a processing upon receipt of the first monophonic signal;

a second filter means, performing a processing upon receipt of the first monophonic signal;

a third filter means, performing a processing upon receipt of the second monophonic signal;

a fourth filter means, performing a processing upon receipt of the second monophonic signal;

a first adding means, adding outputs of the first filter means and that of the fourth filter means so as to produce the first virtual localization output; and a second adding means, adding outputs of the second filer means and that of the third filter means so as to produce as the second virtual localization output.

15. The surround signal-processing device according to claim 7, wherein the virtual localization processing means comprises:

a fifth filter means, performing a processing upon receipt of the first monophonic signal;

a sixth filter means, performing a processing upon receipt of a second monophonic signal;

a seventh filter means, performing a processing upon receipt of an output of the fifth filter means;

a eighth filter means, performing a processing upon receipt of an output of the sixth filter means;

a first adding means, adding an output of the fifth filer means and that of the eighth filter means so as to produce the first virtual localization output; and a second adding means, adding an output of the sixth filer means and that of the seventh filter means so as to produce the second virtual localization output.

16. The surround signal processing device according to claim 15, wherein the virtual localization processing means comprises a delay processing means having a delay in time equal to that defined in the seventh filter means and the eighth filter means respectively in the fifth filter means and the sixth filter means.

17. The surround signal-processing device according to claim 7, wherein the virtual localization processing means comprises:

a ninth filter means, performing a subtract processing between the first monophonic signal and the second monophonic signal so as to produce the first virtual localization output;

a tenth filter means, performing a processing upon receipt of the first monophonic signal;

an eleventh filter means, second monophonic signal; and an adding means, adding performing a processing upon receipt of the an output of the tenth filer means and that of the eleventh filter means so as to produce the second virtual localization output.

18. The surround signal-processing device according to claim 7, wherein the virtual localization processing means comprises:

a twelfth filter means, performing a subtract processing between the first monophonic signal and the second monophonic signal so as to produce the first virtual localization output;

a thirteenth filter means, performing a processing upon receipt of an output of the twelfth filter means;

a fourteenth filter, performing a processing upon receipt of a resulting data generated as a result of performing an adding processing between the first monophonic signal and the second monophonic signal; and an adding means, adding an output of the thirteenth filer means and that of the fourteenth filter means so as to produce the second virtual localization output.

19. The surround signal processing device according to claim 18, wherein the virtual localization processing means comprises a delay processing means having a delay in time equal to that of the thirteenth filter means, the delay processing means being installed respectively in the twelfth filter means and the fourteenth filter means.

20. The surround signal processing device according to claim 18, wherein accuracy of the twelfth filter means in a low frequency region is higher than that of the thirteenth filter means and the fourteenth filter means in the low frequency region.

21. The surround signal processing device according to claim 18, wherein the twelfth filter means includes a processing means performing a filtering processing and a delay attenuation feedback loop connected to an output of the filtering processing;

wherein the thirteenth filter means comprises a processing means performing a filtering processing and a means for performing attenuation and delay processing to an output of the filter means and adding processed output to the output of the filter means;

wherein the fourteenth filter includes a processing means performing a filtering processing and a means for attenuating an output of the processing means;

wherein an output of the twelfth filter means is subjected to a delay processing so as to produce the first virtual localization output; and wherein outputs of the thirteenth filter means and that of the fourteenth filter means are made to the second virtual localization output.

22. The surround signal processing device according to claim 7, the device further comprising:

a fifteenth filter means, performing a processing upon receipt of the second monophonic signal so as to produce the second virtual localization output; and a delay processing means having a delay in time substantially equal to that of the fifteenth filter means and performing a subtract processing between the first monophonic signal and the second monophonic signal so as to produce the first virtual localization output.

23. The surround signal processing device according to claim 7, wherein parameters of the filters, which vary depending on arrangements among the front left speaker, the front center speaker, the front right speaker and the listener, are stored in advance in a storing means; and wherein an optimum parameter is selected in accordance with an arrangement being input.

24. The surround signal processing device according to claim 7, the device further comprising: one of an amplitude adjusting means for compensation and a compensation filter means, each for compensating differences in characteristics between the front right speaker and front left speaker.

* * * * *